US010286250B2

(12) United States Patent
Cordero

(10) Patent No.: US 10,286,250 B2
(45) Date of Patent: May 14, 2019

(54) WEARABLE GYM

(71) Applicant: John Cordero, Arlington, TX (US)

(72) Inventor: John Cordero, Arlington, TX (US)

(73) Assignee: John Cordero, Arlington, TX (US)

( * ) Notice: Subject to any disclaimer, the term of this patent is extended or adjusted under 35 U.S.C. 154(b) by 0 days.

(21) Appl. No.: 15/723,743

(22) Filed: Oct. 3, 2017

(65) Prior Publication Data

US 2018/0021624 A1 Jan. 25, 2018

Related U.S. Application Data

(63) Continuation-in-part of application No. 15/075,647, filed on Mar. 21, 2016.

(51) Int. Cl.

| | |
|---|---|
| ***A41D 1/04*** | (2006.01) |
| ***A61H 1/00*** | (2006.01) |
| ***H04R 1/02*** | (2006.01) |
| ***A61H 23/02*** | (2006.01) |
| ***A63B 21/00*** | (2006.01) |
| ***A63B 21/02*** | (2006.01) |
| ***A63B 21/04*** | (2006.01) |
| ***A63B 23/12*** | (2006.01) |
| ***A63B 24/00*** | (2006.01) |
| ***A63B 71/06*** | (2006.01) |
| ***A63B 21/055*** | (2006.01) |
| ***A63B 23/035*** | (2006.01) |

(52) U.S. Cl.

CPC ..... *A63B 21/4025* (2015.10); *A41D 1/04* (2013.01); *A61H 1/00* (2013.01); *A61H 23/02* (2013.01); *A63B 21/00178* (2013.01); *A63B 21/00192* (2013.01); *A63B 21/023* (2013.01); *A63B 21/0442* (2013.01); *A63B 21/0557* (2013.01); *A63B 21/154* (2013.01); *A63B 21/4007* (2015.10); *A63B 21/4034* (2015.10); *A63B 21/4035* (2015.10); *A63B 21/4043* (2015.10); *A63B 23/0355* (2013.01); *A63B 23/12* (2013.01); *A63B 24/0062* (2013.01); *A63B 24/0087* (2013.01); *A63B 71/0622* (2013.01); *H04R 1/028* (2013.01); *A41D 2600/10* (2013.01); *A61H 2201/0157* (2013.01); *A61H 2201/1207* (2013.01); *A61H 2201/165* (2013.01); *A61H 2201/5097* (2013.01); *A63B 2209/00* (2013.01); *A63B 2209/14* (2013.01); *H04R 2201/023* (2013.01)

(58) Field of Classification Search

CPC ... A63B 21/04–21/0442; A63B 21/065; A63B 21/4025

See application file for complete search history.

(56) References Cited

U.S. PATENT DOCUMENTS 4,993,705 A * 2/1991 Tolle ..... A63B 21/00185 482/124
5,792,034 A * 8/1998 Kozlovsky ..... A63B 21/0004 482/124

(Continued)

*Primary Examiner* — Jennifer M Deichl
(74) *Attorney, Agent, or Firm* — King & Spalding LLP

(57) ABSTRACT

A wearable gym can include base component configured to be worn over a portion of a body of a user. The wearable gym can also include at least one exercise device coupled to the base component, wherein the at least one exercise device is configured to burn calories of the user when the user engages the at least one exercise device.

18 Claims, 17 Drawing Sheets

(56) References Cited

U.S. PATENT DOCUMENTS

| | | | | |
|---|---|---|---|---|
| 2004/0053755 | A1* | 3/2004 | Wilkinson | A63B 21/153<br>482/124 |
| 2005/0034205 | A1* | 2/2005 | Green | A63B 21/0004<br>2/69 |
| 2007/0275824 | A1* | 11/2007 | Murtey | A63B 23/0244<br>482/1 |
| 2012/0151656 | A1* | 6/2012 | Irwin | A63B 21/065<br>2/102 |
| 2014/0142864 | A1* | 5/2014 | Spears | A61B 5/1112<br>702/19 |
| 2014/0200499 | A1* | 7/2014 | Champion | A63B 21/151<br>602/36 |
| 2015/0011368 | A1* | 1/2015 | Manor | A63B 21/0051<br>482/116 |
| 2016/0129296 | A1* | 5/2016 | Haley | A63B 21/0004<br>482/105 |

* cited by examiner

WEARABLE GYM

CROSS REFERENCE TO RELATED APPLICATIONS

This application is a continuation-in-part of and claims priority to U.S. patent application Ser. No. 15/075,647, titled "Wearable Gym" and filed on Mar. 21, 2016, the entire contents of which are hereby incorporated herein by reference.

TECHNICAL FIELD

Embodiments described herein relate generally to exercise equipment, and more particularly to systems, methods, and devices for wearable gyms.

BACKGROUND

A number of people fail to exercise to the extent that they should to be healthy. There are a number of factors that can contribute to this issue. For example, a person can have a job that requires sitting at a desk for extended periods of time or works extended hours and is unable to access traditional exercise equipment or otherwise participate in traditional exercise. As another example, a person can have a health condition that limits the person's mobility (e.g., a broken leg, Multiple Sclerosis) and that prevents the person from being physically active. As yet another example, a person can be older and have difficulty being physically active.

SUMMARY

In general, in one aspect, the disclosure relates to a wearable gym. The wearable gym can include a base component configured to be worn over a portion of a body of a user. The wearable gym can also include at least one exercise device coupled to the base component, where the at least one exercise device is configured to burn calories of the user when the user engages the at least one exercise device.

These and other aspects, objects, features, and embodiments will be apparent from the following description and the appended claims.

BRIEF DESCRIPTION OF THE DRAWINGS

The drawings illustrate only example embodiments of wearable gyms and are therefore not to be considered limiting of its scope, as wearable gyms may admit to other equally effective embodiments. The elements and features shown in the drawings are not necessarily to scale, emphasis instead being placed upon clearly illustrating the principles of the example embodiments. Additionally, certain dimensions or positionings may be exaggerated to help visually convey such principles. In the drawings, reference numerals designate like or corresponding, but not necessarily identical, elements.

DETAILED DESCRIPTION OF EXAMPLE EMBODIMENTS

Figure 1A:
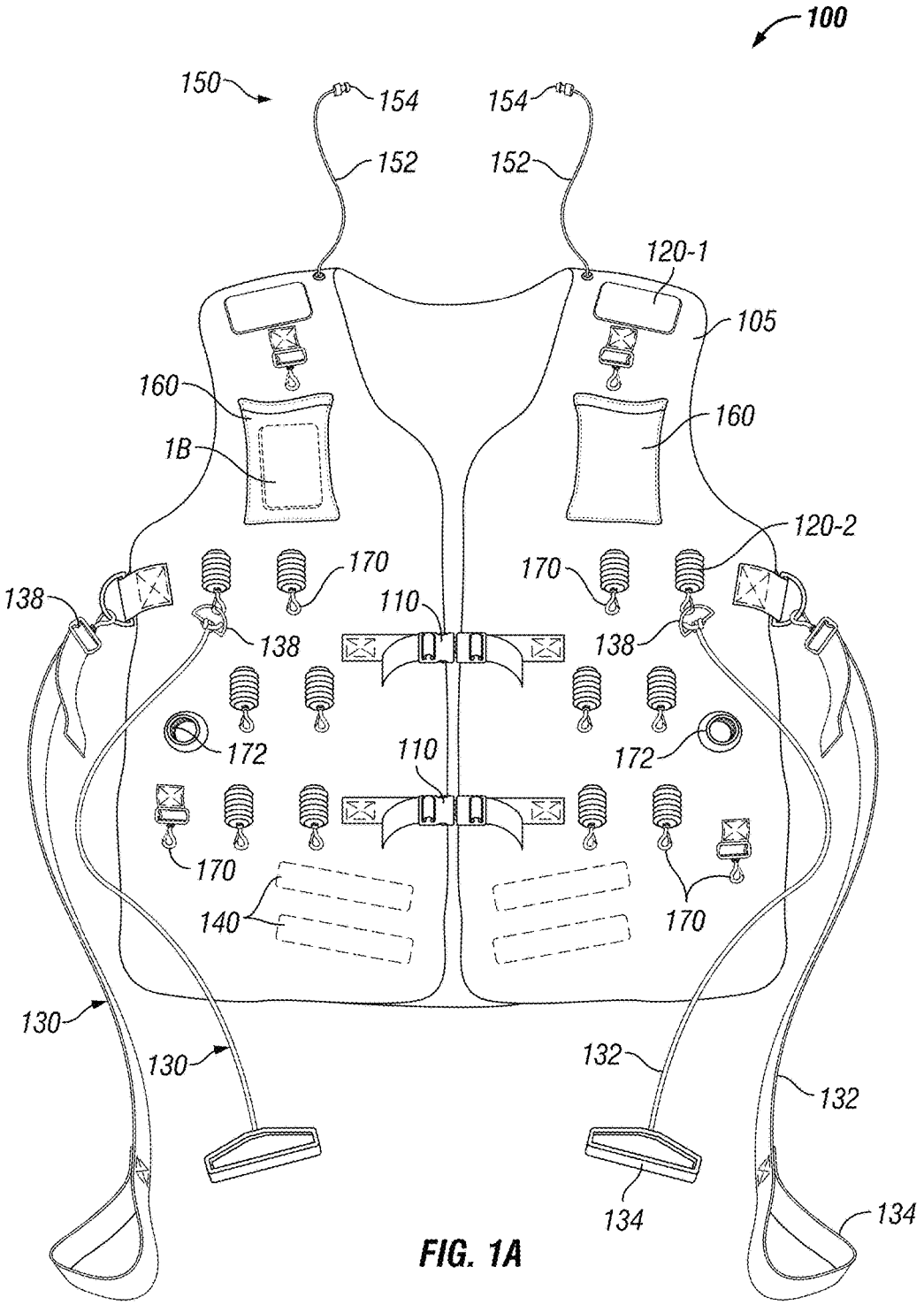
FIGS. 1A and 1B show a wearable gym in accordance with certain example embodiments.

The example embodiments discussed herein are directed to systems, apparatuses, and methods of wearable gyms. As described herein, a user can be any person that interacts with wearable gyms. Examples of a user may include, but are not limited to, an adult, a juvenile, a personal trainer, a fitness instructor, an athlete, a consultant, a contractor, a sales associate, an injured patient under rehabilitative care, and a manufacturer's representative.

In one or more example embodiments, a wearable gym is subject to meeting certain standards and/or requirements. Examples of entities that set and/or maintain such standards can include, but are not limited to, the Underwriters Laboratories (UL), the Human Factors and Ergonomics Society (HFES), the International Organization for Standardization (ISO), and the Occupational Safety and Health Administration (OSHA). Example embodiments are designed to be used in compliance with any applicable standards and/or regulations.

Any example wearable gyms, or portions (e.g., exercise device) thereof, described herein can be made from a single piece or component (as from a single base component piece or a single frame piece). Alternatively, example wearable gyms (or portions thereof) can be made from multiple pieces or components. Further, any wearable gyms (or components thereof) can have any of a number of suitable characteristics (e.g., shapes, sizes, dimensions). Example wearable gyms described herein can be used for any of a number of types of exercise, including but not limited to strength training, fat burning, toning, and cardiovascular.

Components and/or features described herein can include elements that are described as coupling, fastening, securing, abutting, or other similar terms. Such terms are merely meant to distinguish various elements and/or features within a component or device and are not meant to limit the capability or function of that particular element and/or feature. For example, a feature described as a "coupling feature" can couple, secure, fasten, abut, and/or perform other functions aside from merely coupling. In addition, each component and/or feature described herein (including each component of an example wearable gym) can be made of one or more of a number of suitable materials, including but not limited to metal, nylon, spandex, rubber, and plastic (e.g., PVC).

A coupling feature (including a complementary coupling feature) as described herein can allow one or more components and/or portions of a wearable gym (e.g., an exercise device, a base component, a frame) to become coupled, directly or indirectly, to another portion of the wearable gym. A coupling feature can include, but is not limited to, a clamp, a portion of a hinge, an aperture, a recessed area, a protrusion, a slot, a spring clip, a tab, a detent, thread, stitching, and mating threads. One portion of an example wearable gym can be coupled to another portion of the wearable gym by the direct use of one or more coupling features.

In addition, or in the alternative, a portion of an example wearable gym can be coupled to another portion of the wearable gym using one or more independent devices that interact with one or more coupling features disposed on a component of the wearable gym. Examples of such devices can include, but are not limited to, a pin, a hinge, a fastening device (e.g., a bolt, a screw, a rivet), and a spring. One coupling feature described herein can be the same as, or different than, one or more other coupling features described herein. A complementary coupling feature as described herein can be a coupling feature that mechanically couples, directly or indirectly, with another coupling feature.

Any component described in one or more figures herein can apply to any subsequent figures having the same label. In other words, the description for any component of a subsequent (or other) figure can be considered substantially the same as the corresponding component described with respect to a previous (or other) figure. The numbering scheme for the components in the figures herein parallel the numbering scheme for the components of described in another figure in that each component is a three or four digit number having either the identical last two digits. For any figure shown and described herein, one or more of the components may be omitted, added, repeated, and/or substituted. Accordingly, embodiments shown in a particular figure should not be considered limited to the specific arrangements of components shown in such figure.

Example embodiments of wearable gyms will be described more fully hereinafter with reference to the accompanying drawings, in which example wearable gyms are shown. Wearable gyms may, however, be embodied in many different forms and should not be construed as limited to the example embodiments set forth herein. Rather, these example embodiments are provided so that this disclosure will be thorough and complete, and will fully convey the scope of wearable gyms to those of ordinary skill in the art. Like, but not necessarily the same, elements (also sometimes called components) in the various figures are denoted by like reference numerals for consistency.

Terms such as "first", "second", "top", "bottom", "side", "distal", "proximal", "inner", and "outer" are used merely to distinguish one component (or part of a component or state of a component) from another. Such terms are not meant to denote a preference or a particular orientation. Also, the names given to various components described herein are descriptive of one embodiments and are not meant to be limiting in any way. Those of ordinary skill in the art will appreciate that a feature and/or component shown and/or described in one embodiment (e.g., in a figure) herein can be used in another embodiment (e.g., in any other figure) herein, even if not expressly shown and/or described in such other embodiment.

Figure 1B:
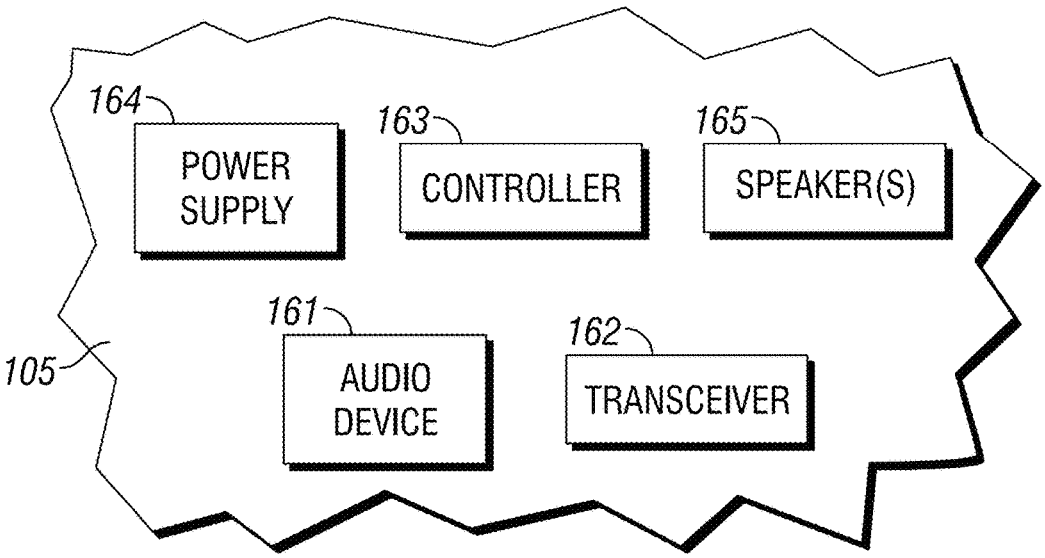

FIGS. 1A and 1B show a wearable gym 100 in accordance with certain example embodiments. Specifically, FIG. 1A shows a front view of the wearable gym 100. FIG. 1B shows a detail inside a pocket of the wearable gym 100. The wearable gym 100 of FIGS. 1A and 1B can include a base component 105 and at least one exercise device. The base component 105 can be anything that can be worn on any part of the body of a user. Examples of a base component 105 can include, but are not limited to, a vest (as shown in FIG. 1A), a long-sleeve shirt, a short-sleeve shirt, a coat, a jacket, a brace, a hat, a pair of shorts, a pair of pants, a sock, and a glove. The base component 105 can be made of one or more of a number of materials, including but not limited to cotton, nylon (or other forms of plastic), metal, foam, rubber, polyester, neoprene, and spandex. The base component 105 can be a solid, a weave, a mesh, and/or any other suitable configuration of the material(s). Finally, a base component 105 can be substantially rigid (e.g., a hard shell), flexible, form fitting, resilient, and/or have any other suitable characteristics.

The base component 105 can have one or more fastening features 110 that secures the base component 105 to itself and/or one or more portions of the body of a user. Fastening features 110 can include one or more of a number of features, including but not limited to straps, clasps, snaps, buckles, notches, latches, clips, belts, Velcro, and zippers. A fastening feature 110 can be fixed or adjustable. As an example, as shown in FIG. 1A, there can be two fastening features 110, where each fastening feature 110 includes a flexible strap with one end fixedly attached to the base component 105 and a second end with a clip. In such a case, the two clips can complement each other so that they can be detachably coupled to each other. One or both of the straps of the fastening features 110 of FIG. 1A can be adjustable in length. In some cases, the base component 105 can have no fastening features 110. For example, a base component 105 can be a sleeve made of a form-fitting elastic material that pulls over a portion of the body of a user.

In certain example embodiments, the base component 105 includes one or more features that couple to (e.g., receive, fasten, cover) an exercise device, a user, and/or another component of the wearable gym 100. For example, the base component 105 can have one or more pockets 160 (a type of receiving feature) in which one or more components of the wearable gym 100 can be disposed. Examples of such components can include, but are not limited to, an audio device 161 (e.g., MP3 player), a power supply 164 (e.g., an energy storage device (e.g., a battery), an energy transfer device, an energy generation device (e.g., photovoltaic solar device)), one or more speakers 165, a signal transceiver 162 (e.g., electrical conductors, a Bluetooth component), a controller 163, an exercise device (e.g., a vibration generator, an electrical pulse generator), a user device, and/or some other component can be disposed.

In certain example embodiments, the controller 163 can include one or more of a number of components. Examples of such components can include, but are not limited to, a control engine, a communication module, a real-time clock, a power module, an energy measurement module, one or more sensors, a display, a storage repository, a hardware processor, a memory, a transceiver, an application interface, and a security module. The controller 163 can correspond to a computer system 1018 as described below with regard to FIG. 10.

As an example, the controller 163 can include an energy measurement module that tracks the amount (e.g., calories, time, reps) of exercise performed by a user of the wearable gym. In this way, the a controller 163 can act like a tracking system that tracks settings and movements of each exercise device when the user engages an exercise device. The controller 163 can then communicate (e.g., using a display, using a transceiver to send the information to a user device, using the audio device 161) the exercise information to the user.

In certain example embodiments, the controller 163 does not include a hardware processor. In such a case, the controller 163 can include, as an example, one or more field programmable gate arrays (FPGA). Using FPGAs and/or other similar devices known in the art allows the controller (or portions thereof) to be programmable and function according to certain logic rules and thresholds without the use of a hardware processor. Alternatively, FPGAs and/or similar devices can be used in conjunction with one or more hardware processors.

When the wearable gym 100 includes an audio device 161, the audio device 161 can output any of a number of sounds. Examples of such sounds can include, but are not limited to, binaural beats, motivational words, music (e.g., user-installed, default), exercise information (e.g., number of reps, calories burned, weight equivalent of an exercise device being engaged by a user, time of exercise, time of day), news items, emails, texts messages, and calendar reminders.

A pocket 160 can be accessible to a user. In such a case, The pocket 160 can have one more open ends that may be secured to the rest of the base component 105. A portion of a pocket 160 can be secured to the rest of the base component 105 using any of a number of coupling features, including but not limited to a snap, Velcro, a zipper a fold, and drawstring. Alternatively, a pocket 160 can be completely and permanently enclosed, preventing a user from accessing the components of the wearable gym 100 that are disposed within the pocket 160.

As another example, the base component 105 can have one or more coupling features 170 (sometimes called device coupling features) that can couple to one or more components of the wearable gym 100. For example, as shown in FIG. 1A, one or more coupling features 170 can be hooks disposed on the base component 105. In such a case, a hook can couple to an exercise device (or portion thereof) (e.g., a resistor device 120, a coupling feature at a proximal end 138 of a strap 130). As an additional example, one or more coupling features 170 can be mating threads disposed in the base component 105. In such a case, the mating threads can couple to an exercise device or portion thereof (e.g., a resistor device 120). Examples of other types of coupling features 170 can include, but are not limited to, apertures, clips, zippers, Velcro, loops, and snaps The base component 105 of the wearable gym 100 can also include one or more coupling features for coupling to one or more user devices. For example, the base component 105 can include an audio jack for coupling to user-supplied wired headphones. As another example, as shown in FIG. 1A, the base component 105 can include a headset 150 (in this case, audio wires 152 and ear buds 154) so that the ear buds 154 can be disposed within the ears of a user. As yet another example, the base component 105 can include a USB port that can be used to transmit communication, power, and/or control signals between the wearable gym 100 (e.g., the power supply 164, the controller 163, the audio device 161, the transceiver 162) and a user (or system associated with a user).

As defined herein, an exercise device is configured to burn calories of the user when the user engages the exercise device. Each exercise device coupled to (e.g., disposed on, attached to) the base component 105 can have one of a number of features, components, and/or configurations. One example of an exercise device, as shown in FIG. 1A, can be a strap 130. In this case, there are four straps 130 coupled, directly or indirectly, to the base component 105. Each strap 130 can have a body 132, a coupling feature 138 disposed at a proximal end of the body 132, and a handle 138 disposed at a distal end of the body 132.

As discussed below with respect to FIG. 3, the body 132 of a strap 130 can be substantially inelastic or substantially elastic. For example, when a strap 130 is coupled to a resistor device 120 (described below), the body 132 of the strap 130 can be substantially inelastic, which allows the resistor device 120 to provide the majority of the resistance against a force applied by a user. As another example, when a strap 130 is coupled directly to the base component 105 (for example, using the coupling feature 170 in the form of a hook), the body 132 of the strap 130 can be substantially elastic, which allows the strap 130 to provide the majority of the resistance against a force applied by a user.

As shown in FIG. 1A, another example of an exercise device can be a vibrating device 140. Each vibrating device 140 emits energy pulses and can be located at a point on the base component 105 that corresponds to an area of the body of the user that is targeted for stimulation and exercise using those energy pulses. For example, if a vibrating device 140 is located proximate to the abdomen of a user when the user is wearing the wearable gym 100, then the vibrating device 140 can stimulate tightening of the abdominal muscles. This can replicate an exercise, such as sit ups or "planking".

When a wearable gym 100 includes one or more vibrating devices 140, the vibrating devices 140 can generate the energy pulses using power supplied from a power supply (e.g., power supply 164). One or more characteristics (e.g., frequency, strength, duration) of the energy pulses emitted by the vibrating devices 140 can be fixed. Alternatively, one or more of the characteristics of the energy pulses emitted by the vibrating devices 140 can be set and/or adjusted (e.g., by a user, automatically).

Figure 2:
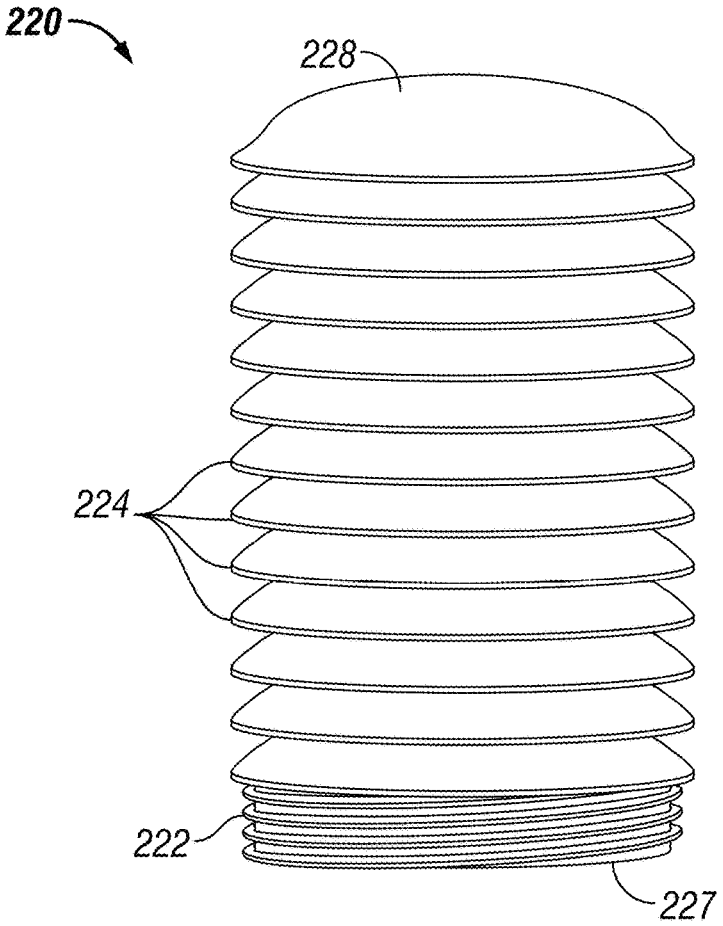
FIG. 2 shows a resistor device in accordance with certain example embodiments.
Figure 4:
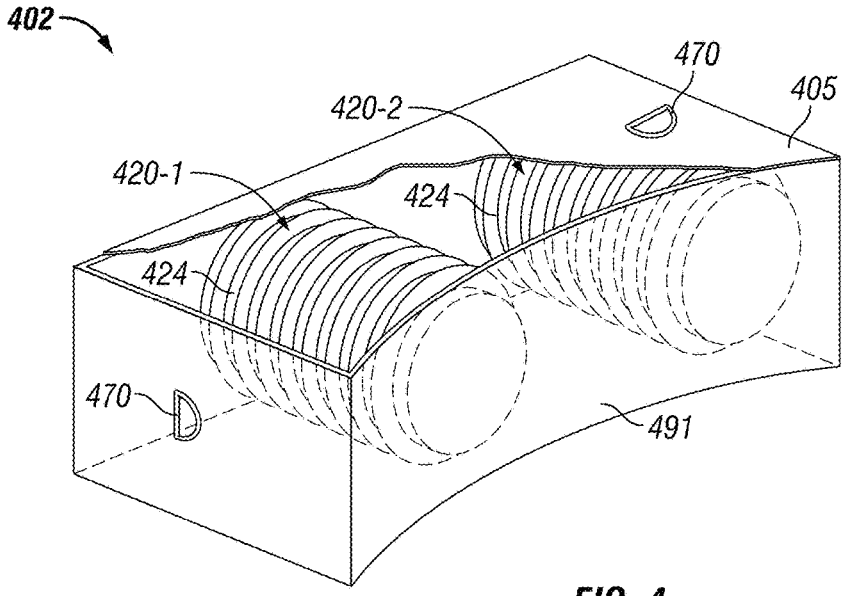
FIG. 4 shows a portion of a wearable gym that includes a resistor device in accordance with certain example embodiments.
Figure 6:
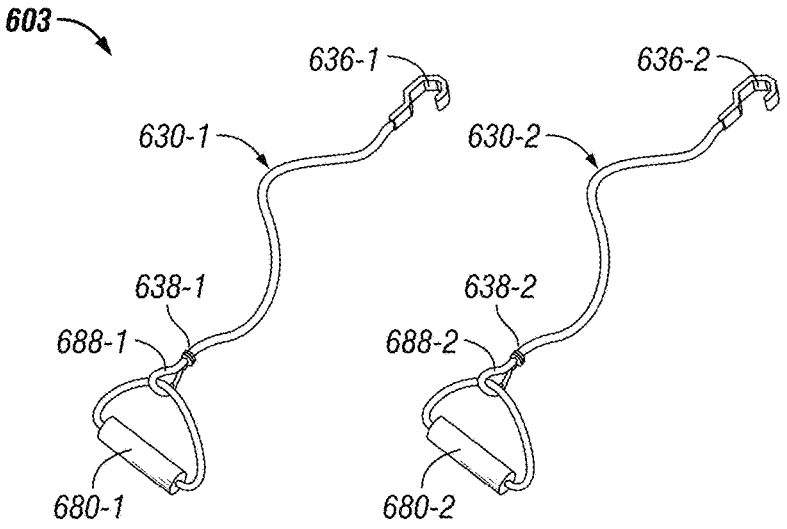

As shown in FIG. 1A, another example of an exercise device can be a resistor device 120 that provides mechanical resistance to a movement made by the user. A resistor device 120 can have one or more of a number of features, components, and/or configurations. For example, FIG. 2 shows a resistor device 220. As another example, FIG. 4 shows another embodiment of a resistor device 420. As still another example, FIG. 6 shows another embodiment of a resistor device 620. A resistor device 120 can have a fixed resistance. Alternatively, a resistor device 120 can have a range of resistances (e.g., discrete, continuous, variable) that can be adjusted by a user.

Figure 3:
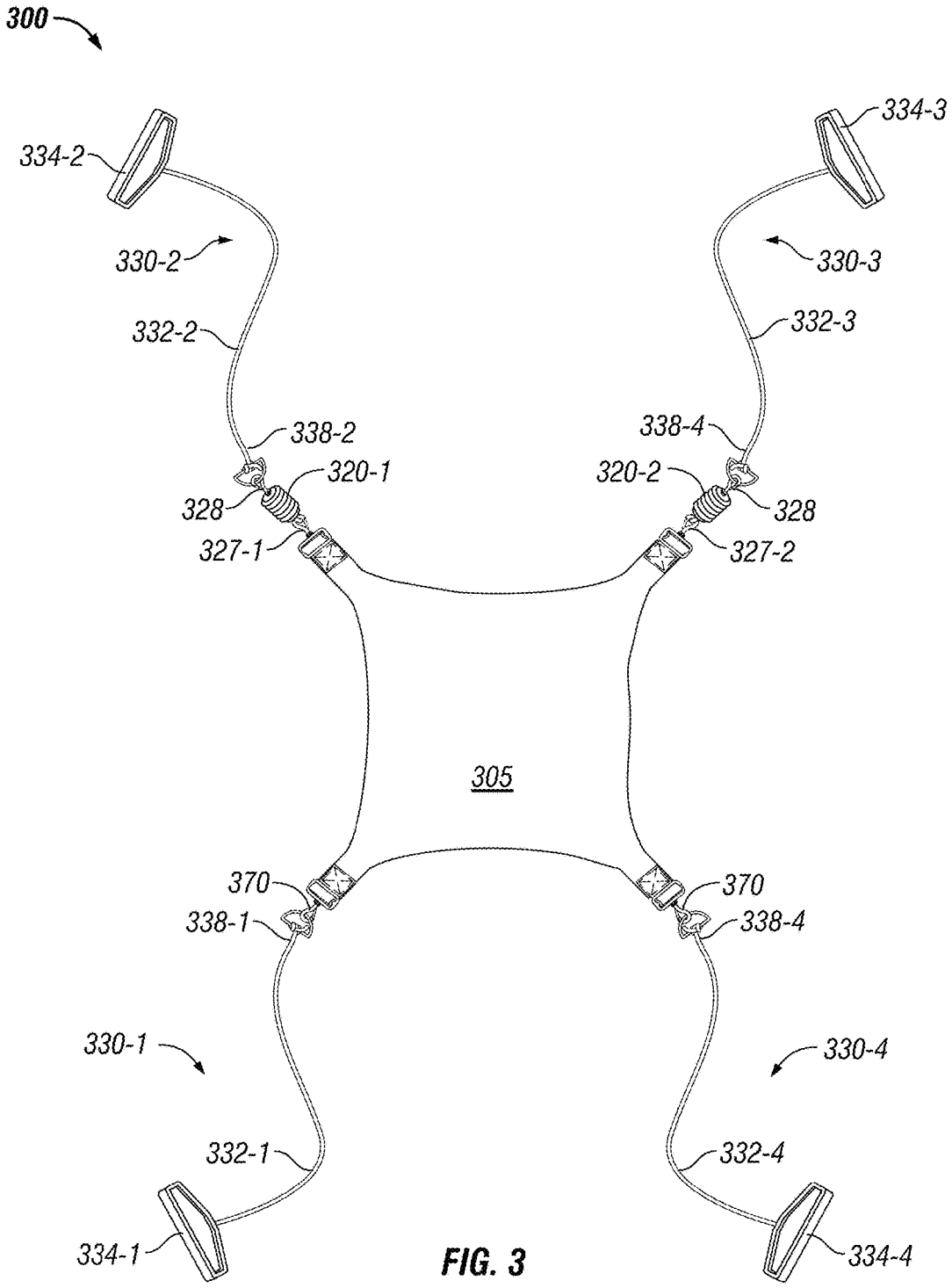
FIG. 3 shows another wearable gym in accordance with certain example embodiments.

Referring to FIGS. 1-3, the resistor device 220 of FIG. 2 (substantially similar to the resistor devices 120-2 shown in FIG. 1) is a resilient device (e.g., a compression spring, a tension spring, a shock absorber) that has a body 224, a bottom end 227, and a top end 228. The bottom end 227 and/or the top end 228 of the resistor device 220 can include a coupling feature. For example, as shown in FIG. 2, the bottom end 227 includes mating threads 222 that complement the mating threads 172 disposed on the base component 105. In such a case, the resistor device 220 can be threadably and removably coupled to the base component 105.

In certain example embodiments, the top end 228 of the resistor device 220 can have one or more of a number of configurations. For example, as shown in FIG. 2, the top end 228 can be smooth and curved. In such a case, the top end 228 can be used to receive a palm of a hand so that a user can apply an inward force to compress the resistor device 220. As another example, the top end 228 can include a handle that allows a user to pull and extend the resistor device 220. As another example, the top end 228 can include a coupling feature.

If the top end 228 of the resistor device 220 includes a coupling feature, then the resistor device 220 can couple to another component of the wearable gym 100. For example, as shown in FIG. 3, the wearable gym 300 has two resistor devices 320 (resistor device 320-1 and resistor device 320-2). The bottom end 327-1 of resistor device 320-1 is coupled to one part of the base component 305, and the bottom end 327-2 of resistor device 320-2 is coupled to another part of the base component 305.

The top end 328-1 of resistor device 320-1 in FIG. 3 can include a coupling feature (e.g., clip, mating threads, hook) that couples to a complementary coupling feature (e.g., coupling feature 138 of FIG. 1, coupling feature 338-2 of FIG. 3) of a strap (e.g., strap 130 of FIG. 1, strap 330-1 of FIG. 3). Examples of such a coupling feature can include, but are not limited to, a clip, mating threads, and a hook. The coupling feature (e.g., coupling feature 138) can be disposed at some location (e.g., a proximal end) of the body (body 132 in FIG. 1, body 332-2 in FIG. 3) of the strap. Similarly, the top end (e.g., top end 328-2) of a resistor device (e.g., resistor device 320-2) can include a coupling feature that couples to a complementary coupling feature (e.g., coupling feature 338-3) of a strap (e.g., strap 332-3).

A strap (e.g., strap 130 of FIG. 1, strap 330-4 of FIG. 3) can also have a handle (handle 134 in FIG. 1, handle 334-2 in FIG. 3) disposed at some portion (e.g., distal end) of the body (body 132 in FIG. 1, body 332-3 in FIG. 3). The handle of a strap can be of any shape and/or size to allow a portion (e.g., a hand, a foot) to fit within the handle. The body of a strap can be substantially inelastic or relatively inelastic. For example, if a strap is coupled to a resistor device (e.g., device 320-1, resistor device 320-2), the body of the strap can be substantially inelastic so that the resistor device can provide substantially all of the resistance against the movements of the user pulling on the handle of the strap.

The wearable gym 300 of FIG. 3 also shows two other straps (strap 330-1 and strap 330-4) that are coupled directly to a coupling feature (in this case, hooks 370) disposed on the base component 305 at their proximal end. In this case, strap 330-1 includes a body 332-1 and a handle 338-1 disposed at its distal end, and strap 330-4 includes a body 332-4 and a handle 338-4 disposed at its distal end. In this case, body 332-1 and body 332-4 can be made of a substantially elastic material. In this way, strap 330-1 and strap 330-4 can provide substantially all of the resistance against the movements of the user pulling on handle 334-1 and handle 334-4. The handle (e.g., handle 134, handle 334-1) of a strap can be called by any of a number of other suitable names, including but not limited to a stirrup.

Referring to FIGS. 1-4, the resistor devices 420 (resistor device 420-1, resistor device 420-2) of FIG. 4 (substantially similar to the resistor devices 120-1 shown in FIG. 1) are also resilient devices, but in this case, the resistor devices 420 are integrated with the base component 405 and/or a separate subassembly 402 (e.g., a detachable shoulder pad) in which the resistor devices 420 are integrated. If the resistor devices 420 are integrated with a separate subassembly 402 that couples to the base component, as in this case, the separate subassembly 402 can include one or more coupling features (e.g., hooks 470) to couple to the base component, an exercise device, and/or some other component of the wearable gym.

The resistor devices 420 shown in FIG. 4 can be used to resist movements of a user. For example, a user can use the subassembly 402 to perform shoulder shrugs, lifting his/her shoulders against the resistance offered by the resistor devices 420. In this case, the resistor devices 420 can be elastic material (rather than a spring made of metal, plastic, rubber, or some other material) that has a resiliency to return to its natural state absent a force applied against it.

The subassembly 402 can have any of a number of features (e.g., shape, contours). For example, the subassembly 402 of FIG. 4 can have a bottom surface 491 that is contoured to abut against a shoulder. Similarly, the resistor devices 420 can be oriented (in this case, vertically upward) in a manner consistent with the contour of the bottom surface 491.

Figure 5:
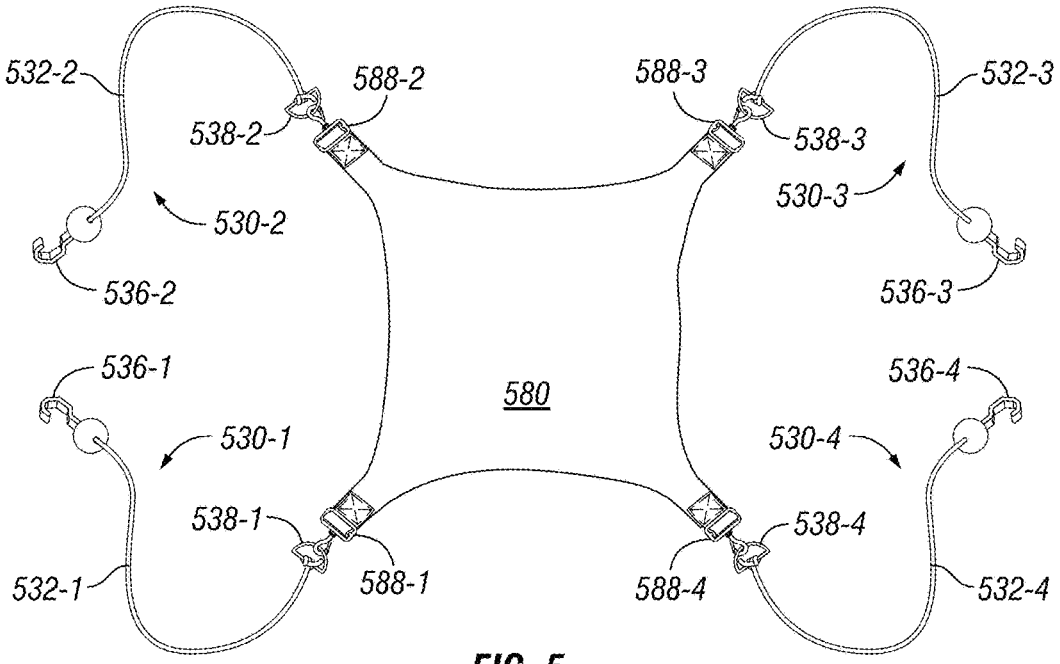
FIGS. 5 and 6 show anchor components of a wearable gym in accordance with certain example embodiments.

In some cases, a separate component of the wearable gym can be used to help stabilize another portion of the wearable gym. FIGS. 5 and 6 show examples of an anchor component that can be used to stabilize the base component (e.g., base component 105) of a wearable gym. Specifically, FIG. 5 shows anchor component 503, and FIG. 6 shows anchor component 603. Referring to FIGS. 1-6, the anchor component 503 of FIG. 5 includes an anchor 580 and one or more (in this case, four) straps 530 that are coupled to the anchor 580. The anchor 580 can be, for example, a firm or flexible platform (as shown in FIG. 5A) or a type of handle (e.g., a stirrup, as shown in FIG. 6).

Each strap 530 (strap 530-1, strap 530-2, strap 530-3, and strap 530-4) can be substantially the same as the straps described above. In this case, the proximal end 538 of each strap 530 can be permanently or detachably coupled to the anchor 580. The anchor can include one or more coupling features 588 that are configured to couple to the proximal end 538 of the strap 530. The distal end 536 of each strap 530 can include one or more coupling features (in this case, a hook) that couple to one or more coupling features 170 (e.g., hook, mating threads, aperture) disposed on a base component (e.g., base component 105) or a frame (described below).

When a user engages (e.g., stands on, sits on) the anchor 580 when the straps 530 are coupled to the base component or a frame, the anchor component 503 stabilizes the base component or frame relative to the user as the user engages one or more of the exercise devices (e.g., exercise device 120, exercise device 130) or portions thereof. The anchor component 603 of FIG. 6 has two anchors 680 (anchor 680-1 and anchor 680-2) that are each configured as a handle. Anchor 680-1 has coupling feature 688-1 that couples to a coupling feature at the proximal end 638-1 of strap 630-1. Similarly, anchor 680-2 has coupling feature 688-2 that couples to a coupling feature at the proximal end 638-2 of strap 630-2.

Figure 7:
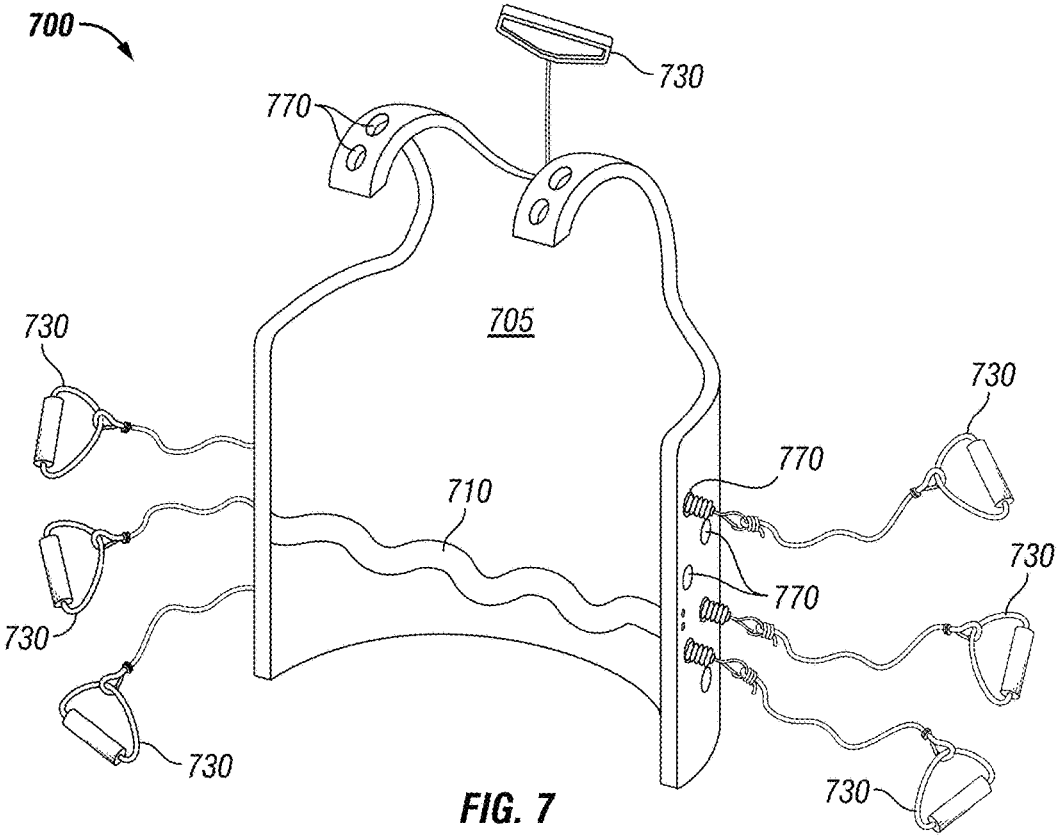
FIG. 7 shows yet another wearable gym in accordance with certain example embodiments.

FIG. 7 shows a frame 725 of another wearable gym 700 in accordance with certain example embodiments. Referring to FIGS. 1-7, the frame 725 of the wearable gym 700 of FIG. 7 in this case is substantially rigid (stiff) with a padded inside (that abuts against the body of the user) and a hard (e.g., plastic, metal) outer portion. When the frame 725 is covered with some material (e.g., cloth, plastic, neoprene), the resulting combination can be a base component.

As can be seen in FIG. 7, the frame 725 can rest over the shoulders, cover most of the back and sides, and cover at least some of the front of the torso of a user. When the frame 725 is a rigid structure, the frame 725 can be a single piece. As discussed above, a frame 725 can be made of multiple pieces that are coupled to each other. Alternatively, a rigid frame 725 can be made of multiple pieces that are coupled (e.g., hingedly, detachably) coupled to each other using one or more of a number of coupling features disposed on each piece. The frame 725 of the wearable gym 700 of FIG. 7 can be coupled to the coupling features at the distal end (e.g., distal end 536) of the straps (e.g., straps 530) of an anchor component (e.g., anchor component 503 of FIG. 5). For example, if the anchor component 503 of FIG. 5 couples to the frame 725 in FIG. 7, then the coupling features (in this case, hooks) at the distal end 536 of the straps 530 can couple to (be disposed within) some of the coupling features 770 (in this case, apertures) in the frame 725 of the wearable gym 700. In this case, a belt 710 is attached to the front panels of the frame 725 to help stabilize the frame 725 to the torso of a user.

Figure 8:
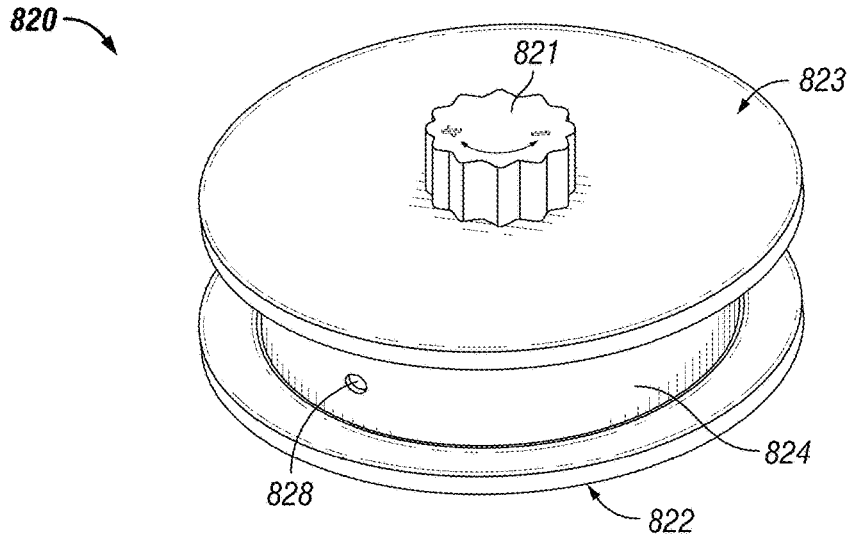
FIG. 8 shows another resistor device for a wearable gym in accordance with certain example embodiments.
Figure 9:
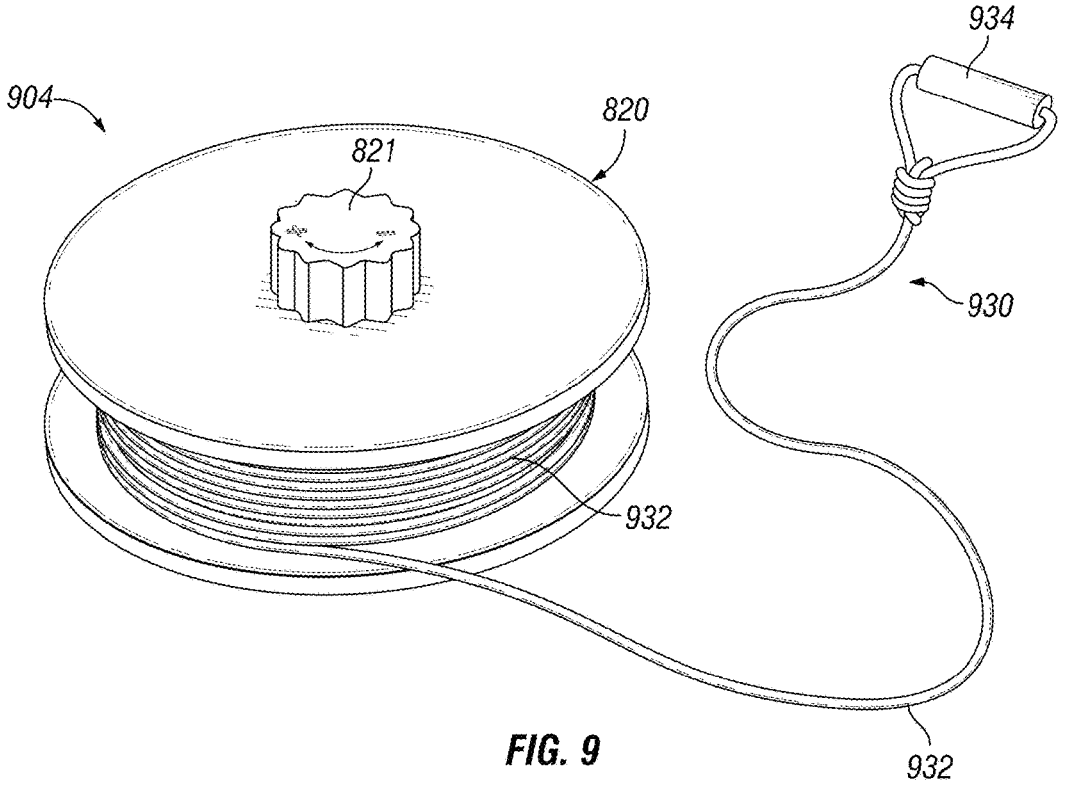
FIG. 9 shows a subassembly of a wearable gym in accordance with certain example embodiments.

FIG. 8 shows another resistor device 820 for a wearable gym in accordance with certain example embodiments. FIG. 9 shows a subassembly of a wearable gym that includes the resistor device 820 of FIG. 8 in accordance with certain example embodiments. Referring to FIGS. 1-9, the resistor device 820 in FIG. 8 is a resistive pulley (using, for example, a braking spring). The resistor device 820 includes a top surface 823, a bottom surface 822, a receiving surface 824 disposed between the top surface 823 and the bottom surface 822, a coupling feature 828, and a resistance adjustment component 821.

The receiving surface 824 can be recessed relative to (e.g., encased by) the top surface 823 and the bottom surface 822. The coupling feature 828 can be used to couple to a distal end (e.g., distal end 138) of a strap. For example, as shown in FIG. 9, the distal end (hidden from view) of the strap 930 can be coupled to the coupling feature 828. As a result, the body 932 of the strap 930 can be wrapped around the receiving surface 824 of the resistor device 820 one or more times.

The resistance adjustment component 821 can serve one or more functions. For example, the resistance adjustment component 821 can act as a rotational axis for the rest of the resistor device 820. In such a case, when the strap 930 is engaged with the resistor device 820, as shown in FIG. 9, as the strap is pulled, the receiving surface 824, the top surface 823, and the bottom surface 822 of the resistor device 820 can rotate around the resistance adjustment component 821 in one direction. Similarly, the resistor device 820 can have a spring return mechanism so that, when the strap 930 is no longer being pulled, the receiving surface 824, the top surface 823, and the bottom surface 822 of the resistor device 820 rotates in the opposite direction to gather the strap 930 within the receiving surface 824.

The resistance adjustment component 821 can also be used to adjust the amount of resistance applied to the rotation of the rest of the resistor device 820. For example, the resistance adjustment component 821 can be rotated by a user to adjust (e.g., increase, decrease) the resistance, which can make it easier (when the resistance is decreased) or more difficult (when the resistance is increased) to pull the strap 930. In certain example embodiments, the bottom surface 822 of the resistor device 820 includes one or more coupling features that couplies to one or more complementary coupling features disposed on a frame (e.g., frame 725) of a wearable gym.

Figure 10:
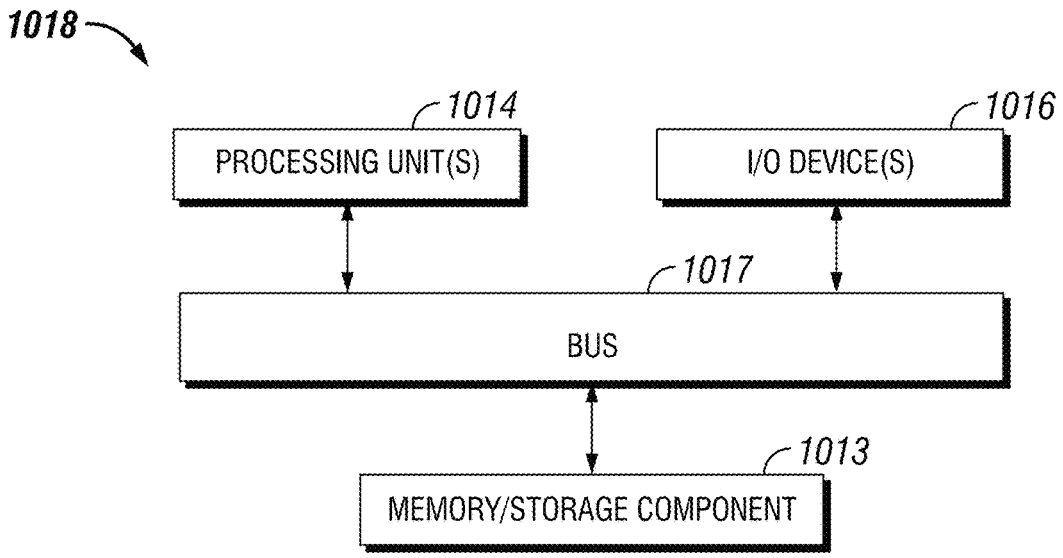
FIG. 10 shows a computing device in accordance with certain example embodiments.

FIG. 10 illustrates one embodiment of a computing device 1018 that implements one or more of the various techniques described herein, and which is representative, in whole or in part, of the elements described herein pursuant to certain exemplary embodiments. Computing device 1018 is one example of a computing device and is not intended to suggest any limitation as to scope of use or functionality of the computing device and/or its possible architectures. Neither should computing device 1018 be interpreted as having any dependency or requirement relating to any one or combination of components illustrated in the example computing device 1018.

Computing device 1018 includes one or more processors or processing units 1014, one or more memory/storage components 1019, one or more input/output (I/O) devices 1016, and a bus 1017 that allows the various components and devices to communicate with one another. Bus 1017 represents one or more of any of several types of bus structures, including a memory bus or memory controller, a peripheral bus, an accelerated graphics port, and a processor or local bus using any of a variety of bus architectures. Bus 1017 includes wired and/or wireless buses.

Memory/storage component 1019 represents one or more computer storage media. Memory/storage component 1019 includes volatile media (such as random access memory (RAM)) and/or nonvolatile media (such as read only memory (ROM), flash memory, optical disks, magnetic disks, and so forth). Memory/storage component 1019 includes fixed media (e.g., RAM, ROM, a fixed hard drive, etc.) as well as removable media (e.g., a Flash memory drive, a removable hard drive, an optical disk, and so forth).

One or more I/O devices 1016 allow a customer, utility, or other user to enter commands and information to computing device 1018, and also allow information to be presented to the customer, utility, or other user and/or other components or devices. Examples of input devices include, but are not limited to, a keyboard, a cursor control device (e.g., a mouse), a microphone, a touchscreen, and a scanner. Examples of output devices include, but are not limited to, a display device (e.g., a monitor or projector), speakers, outputs to a lighting network (e.g., DMX card), a printer, and a network card.

Various techniques are described herein in the general context of software or program modules. Generally, software includes routines, programs, objects, components, data structures, and so forth that perform particular tasks or implement particular abstract data types. An implementation of these modules and techniques are stored on or transmitted across some form of computer readable media. Computer readable media is any available non-transitory medium or non-transitory media that is accessible by a computing device. By way of example, and not limitation, computer readable media includes "computer storage media".

"Computer storage media" and "computer readable medium" include volatile and non-volatile, removable and non-removable media implemented in any method or technology for storage of information such as computer readable instructions, data structures, program modules, or other data. Computer storage media include, but are not limited to, computer recordable media such as RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which is used to store the desired information and which is accessible by a computer.

The computer device 1018 is connected to a network (not shown) (e.g., a local area network (LAN), a wide area network (WAN) such as the Internet, cloud, or any other similar type of network) via a network interface connection (not shown) according to some exemplary embodiments. Those skilled in the art will appreciate that many different types of computer systems exist (e.g., desktop computer, a laptop computer, a personal media device, a mobile device, such as a cell phone or personal digital assistant, or any other computing system capable of executing computer readable instructions), and the aforementioned input and output means take other forms, now known or later developed, in other exemplary embodiments. Generally speaking, the computer system 1018 includes at least the minimal processing, input, and/or output means necessary to practice one or more embodiments.

Further, those skilled in the art will appreciate that one or more elements of the aforementioned computer device 1018 is located at a remote location and connected to the other elements over a network in certain exemplary embodiments. Further, one or more embodiments is implemented on a distributed system having one or more nodes, where each portion of the implementation (e.g., controller 163) is located on a different node within the distributed system. In one or more embodiments, the node corresponds to a computer system. Alternatively, the node corresponds to a processor with associated physical memory in some exemplary embodiments. The node alternatively corresponds to a processor with shared memory and/or resources in some exemplary embodiments.

Figure 11A:
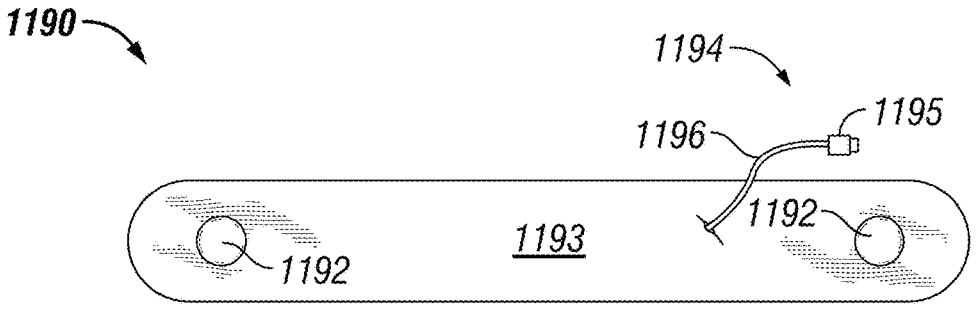
FIGS. 11A and 11B show a detachable component of a wearable gym in accordance with certain example embodiments.
Figure 11B:
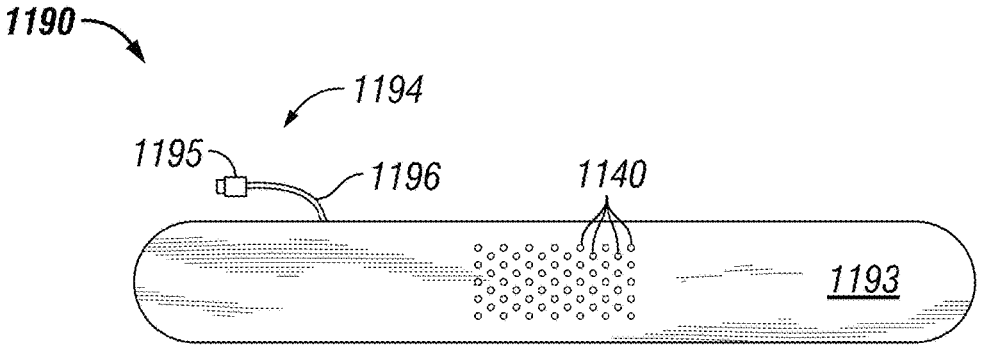

FIGS. 11A and 11B show a detachable component 1190 of a wearable gym in accordance with certain example embodiments. Specifically, FIG. 11A shows a back side of the detachable component 1190, and FIG. 11B shows a front side of the detachable component 1190. In certain example embodiments, the detachable component 1190 can include one or more coupling features 1192 (e.g., snaps, Velcro) that couple to complementary coupling features (e.g., coupling features 170) of a base component (e.g., base component 105) or a frame (e.g., frame 725). In this case, the coupling features 1192 are disposed on the back side of the body 1193 of the detachable component 1190.

The detachable component 1190 can also include an optional electrical connector 1194. In such a case, one end of the electrical cable 1196 (e.g., one or more electrical conductors) is coupled to one or more vibrating devices 1140 disposed on the front side of the body 1193. The other end of the electrical cable 1196 can be coupled to an electrical connector end 1195, which can be used to couple to a complementary electrical connector end disposed on the base component (or frame thereof) of the wearable gym. The electrical connector 1194 can be used to transmit signals (e.g., power, control, communication) between the vibrating devices 1140 and the controller (e.g., controller 163) of the base component (or frame thereof).

In addition to the electrical connector 1194, or in the alternative of having the electrical connector 1194, one or more of the signals can be transmitted between the vibrating devices 1140 and the controller wirelessly. As another alternative to the electrical connector 1194, one or more of the signals sent between the vibrating devices 1140 and the controller can be transmitted through a coupling feature 1192.

In certain example embodiments, the vibrating devices 1140 operate like the "vibration" mode on a cell phone. In this case, if the user touches (or, in some cases, comes close to touching) the vibrating devices 1140, then the vibrating devices 1140 will operate (vibrate). When this occurs, it will signal the user to tighten the muscles adjacent to the vibrating devices 1140. For example, if the vibrating devices 1140 come into contact with the abdomen of a user, the vibrating devices 1140 will vibrate, alerting the user to keep his abdominal muscles. When this occurs, the vibrating devices 1140 lose contact with the abdomen of the user, and so the vibrating devices 1140 will stop vibrating. This simulates a "planking" exercise.

In certain example embodiments, the detachable component 1190 can be coupled to multiple locations on a base component or portion thereof (e.g., a frame). In such a case, a user can move the detachable component 1190 from one location on the base component or portion thereof (e.g., a frame) to another location to use the vibrating devices 1140 as a reminder to tighten various muscles, thereby exercising those muscles. Also, the coupling features 1192 can be disposed on any portion of the detachable component 1190, not just the front side of the body 1193.

Figure 12A:
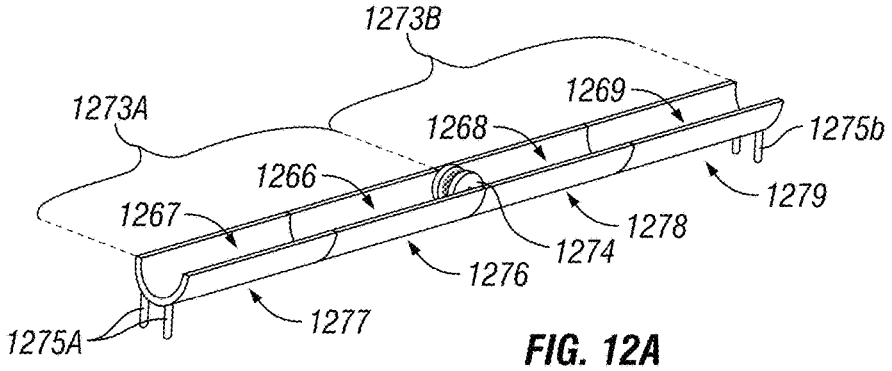
FIGS. 12A-12D show a detachable component of a wearable gym in accordance with certain example embodiments.
Figure 12B:
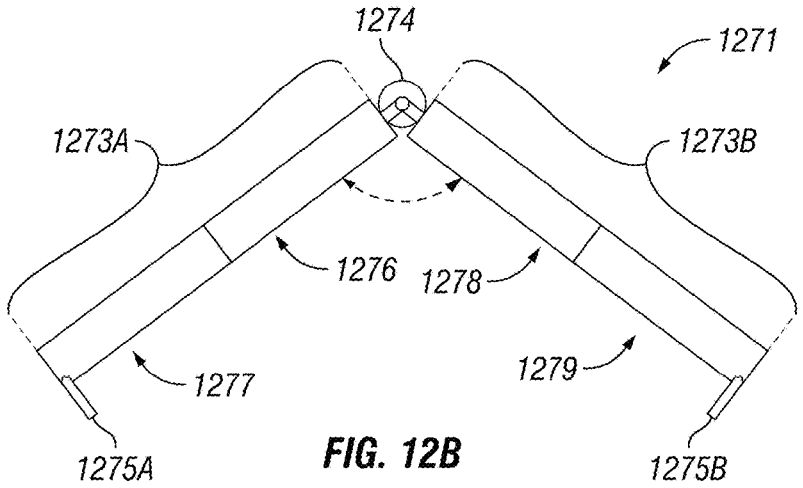
Figure 12C:
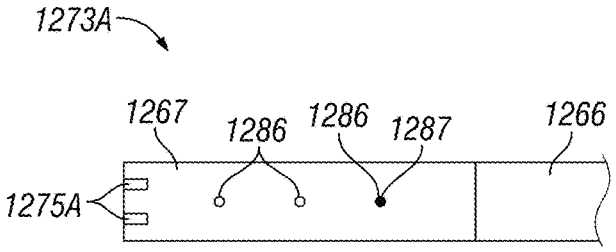
Figure 12D:
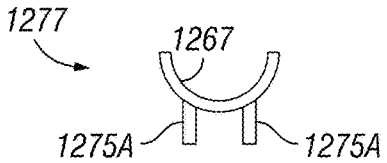

FIGS. 12A-12D show a detachable component 1271 of a wearable gym in accordance with certain example embodiments. FIG. 12A shows a top-side perspective view of the detachable component 1271. FIG. 12B shows a side view of the detachable component 1271. FIG. 12C shows a bottom view of the detachable component 1271. FIG. 12D shows a cross-sectional front view of the detachable component 1271.

The detachable component 1271 (a type of anchor component) can include one or more of a number of components. For example, the detachable component 1271 of FIGS. 12A-12D includes multiple (in this case, two) portions 1273: portion 1273A and portion 1273B. In certain example embodiments, each portion has a length that can be adjusted. For example, each portion 1273 can have one or more segments. In this case, portion 1273A includes segment 1276 and segment 1277, and portion 1273B includes segment 1278 and segment 1279. In such a case, each segment of a portion 1273 can be movably (e.g., slidably, as in this case) coupled to each other.

Each segment of a portion 1273 can have a substantially similar cross-sectional shape relative to each other. For example, as shown in FIG. 12D, the cross-sectional shape of the body 1267 of segment 1277 is U-shaped. Similarly, of the body 1266 of segment 1276 of portion 1273A is U-shaped. The body 1268 of segment 1278 and of the body 1269 of segment 1279 of portion 1273B of FIGS. 12A-12D have the same U-shape. As stated above, each segment of a portion 1273 in this example is slidably coupled to each other. To have a length of a portion 1273 become fixed, one or more of a number of coupling features (e.g., detents, tabs, apertures, recesses, protrusions) can be disposed on one or more of the segments of the portion 1273. For example, in this case, as shown in FIG. 12C, one segment (e.g., segment 1277) of portion 1273A has a number (in this case, three) of coupling features 1286 (in this case, apertures) that traverse the body 1267 in a linear orientation along the length of the segment.

To complement these coupling features 1286 of segment 1277, segment 1276 can have a number (in this case, one) of coupling features 1287 disposed on its body 1266. In this case, the coupling feature 1287 is a retractable protrusion that is shaped and sized in such a way as to allow the coupling feature 1287, when in a natural state, to extend through one of the coupling features 1286 of segment 1277. In this example, if a user wants to adjust the length of the portion 1273A, coupling feature 1287 can be depressed, allowing the user to slide segment 1276 and segment 1277 relative to each other. When the desired length of the portion 1273A is achieved, then coupling feature 1287 can align with and protrude through the next closest coupling feature 1286 to affix the length of the portion 1273A.

In certain example embodiments, there is a pivot feature 1274 disposed between two adjacent portions 1273 of the detachable component 1271. The pivot feature 1274 can allow an angle 1297 between the two adjacent portions 1273 to be adjusted. In addition, or in the alternative, two adjacent portions 1273 can be adjustable coupled to each other in some other way (e.g., hinged extensions) that allow for the angle 1297 between the adjacent portions 1273 to be adjustable. The pivot feature 1274 can allow a portion (e.g., a body) of an exercise device (e.g., a strap) to pass therealong with reduced friction.

At least one of the portions 1273 of the detachable component 1271 can include one or more coupling features 1275 that allow the detachable component 1271 to couple to a wearable gym. In this case, the coupling features 1275 are two protrusions that extend from the bottom of the distal end of each portion 1273. Specifically, coupling features 1275A extend from the distal end of segment 1277 of portion 1273A, and coupling features 1275B extend from the distal end of segment 1279 of portion 1273B.

Figure 13A:
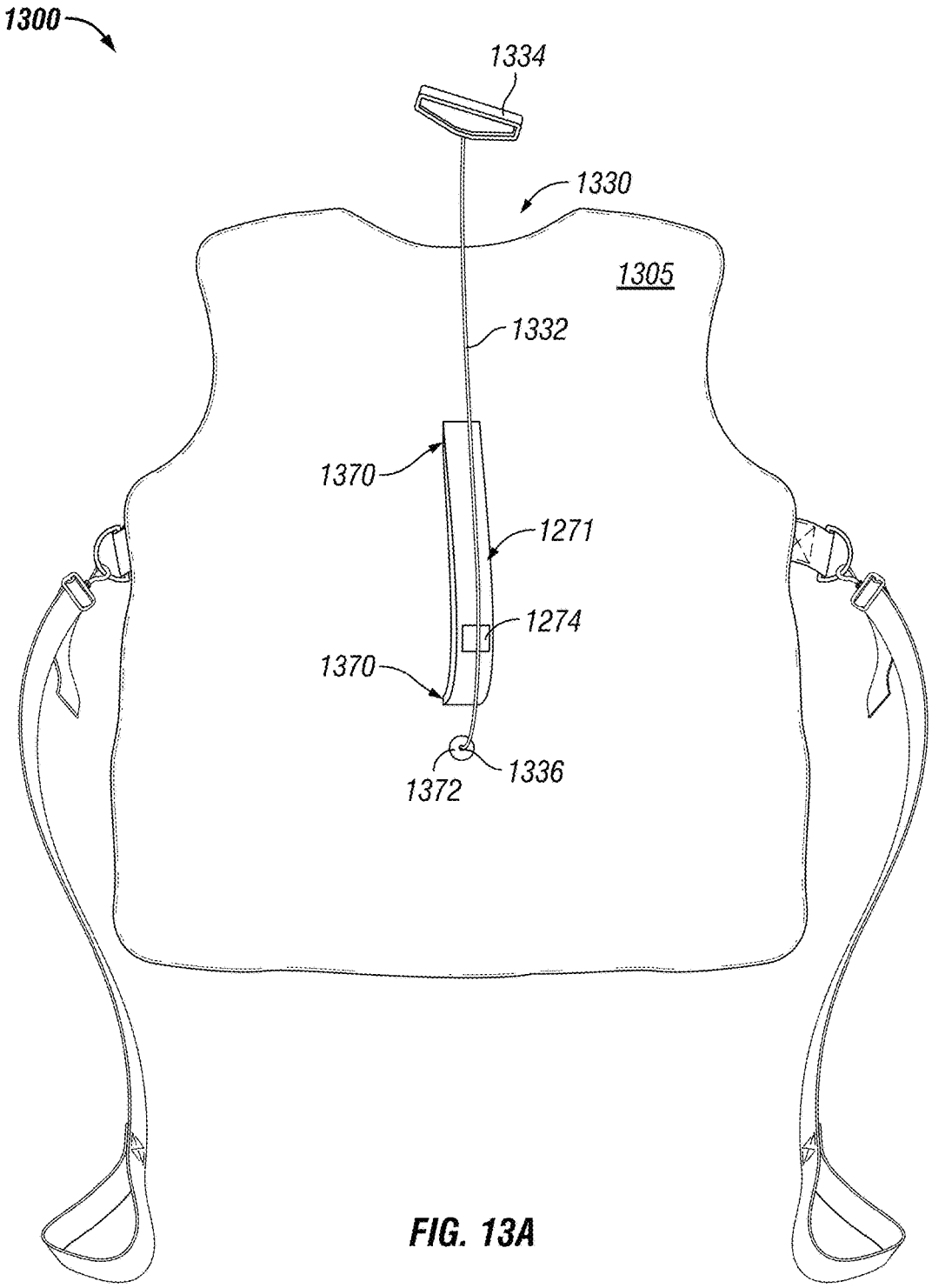
FIGS. 13A and 13B show a wearable gym that includes the detachable component of FIGS. 12A-12D in accordance with certain example embodiments.
Figure 13B:
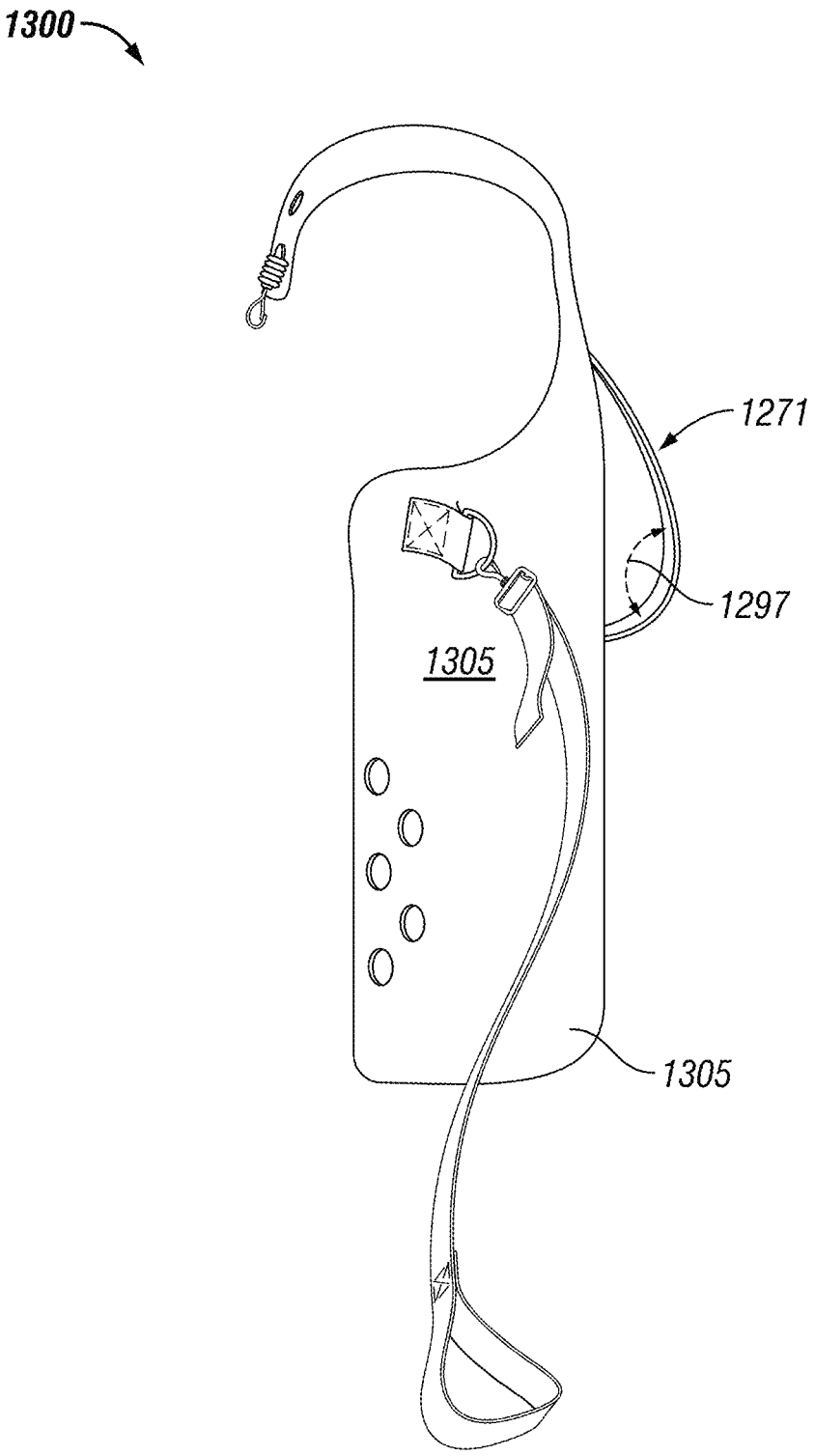

FIGS. 13A and 13B show an example of the detachable component 1271 of FIGS. 12A-12D coupled to the base component 1305 (in this case, a rigid frame covered by cloth) of a wearable gym 1300. The frame of the base component 1305 of FIGS. 13A and 13B is substantially similar to the frame 725 of FIG. 7 in that the frame of the base component 1305 of FIGS. 13A and 13B is substantially stiff (e.g., made of plastic, made of metal). Coupling features 1275A and coupling features 1275B (hidden from view in FIGS. 13A and 13B) are coupled to coupling features 1370 disposed in the base component 1305. The location of the coupling features 1370 in the base component 1305 (or, more specifically, the frame) to which the coupling features 1275 of the detachable component 1271 are coupled determines the angle 1297 between portion 1273A and portion 1273B.

Strap 1330 is also part of the wearable gym 1300. The distal end 1336 of the strap 1330 in this case includes a coupling features (in this case, mating threads) that couple to complementary mating threads 1372 (a form of coupling feature) disposed in the base component 1305. The location of the mating threads 1372 relative to the coupling features 1370 on the base component 1305 allow the body 1332 of the strap 1330 to be positioned, at least in part, within the U-shaped channel of at least part of the detachable component 1271 as well as the pivot feature 1274.

When used as shown in FIGS. 13A and 13B, the detachable component 1271 can be used to act as a force distribution mechanism that allows a user to pull on the handle 1334 of the strap 1330 without pulling the base component 1305 off of the body of the user. In addition, the U-shape of the portions 1273 of the detachable component 1271 as well as the pivot feature 1274 help reduce frictional wear of the body 1332 of the strap 1330 as the strap 1330 is used over time. When the frame of the base component 1305 is substantially stiff or rigid, as in FIGS. 13A and 13B, the detachable component 1271 can be used more effectively in distributing the forces associated with using the strap 1330 or other exercise device.

Figure 14:
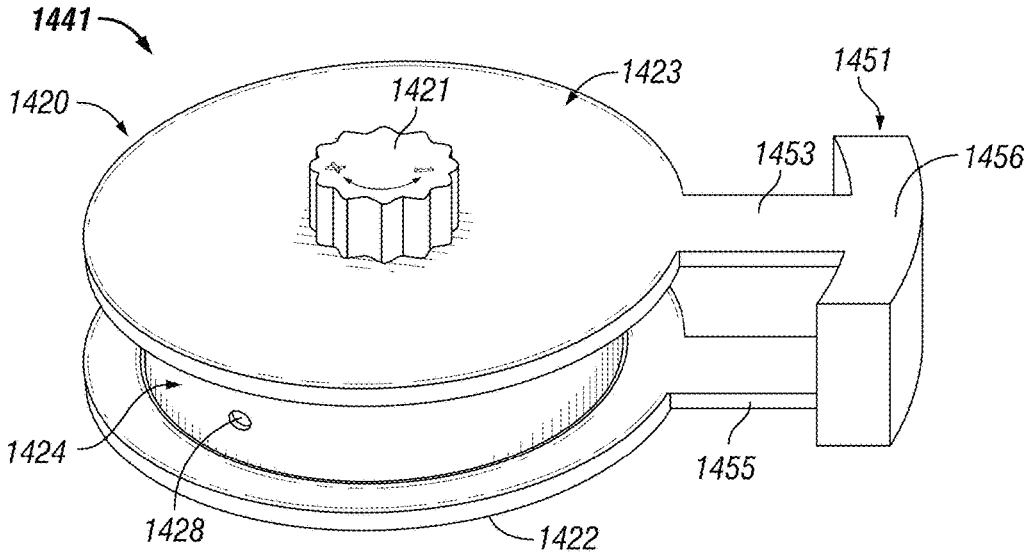
FIGS. 14 and 15 show enhanced resistor devices in accordance with certain example embodiments.
Figure 15:
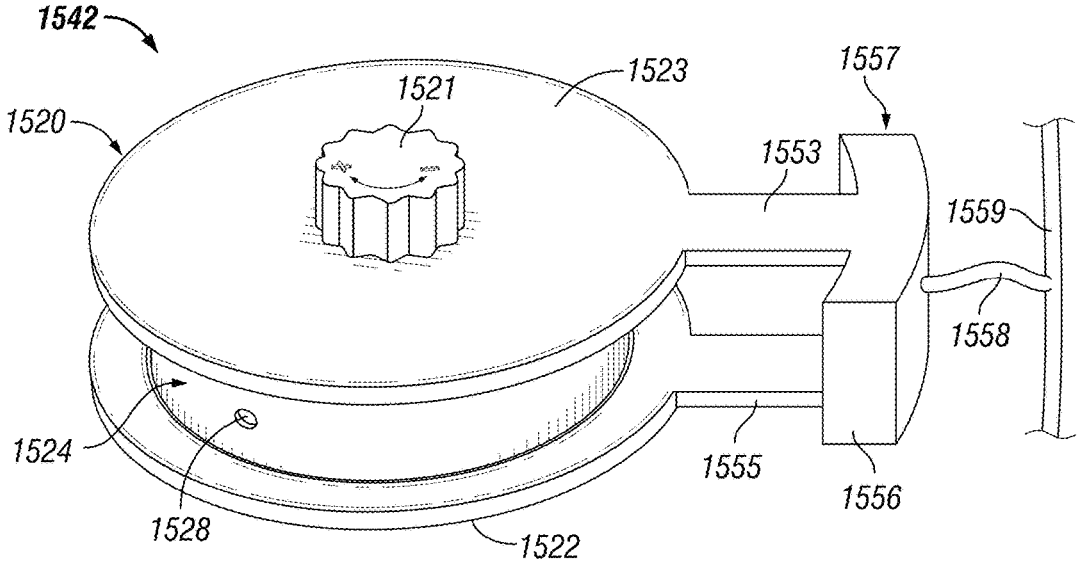

FIGS. 14 and 15 show enhanced resistor devices in accordance with certain example embodiments. Specifically, FIG. 14 shows a system 1441 that includes a resistor device 1451 used in conjunction with another resistor device 1420, and FIG. 15 shows a resistor device 1557 used in conjunction with another resistor device 1520. Resistor device 1420 of FIG. 14 and resistor device 1520 of FIG. 15 is a pulley that is substantially the same as the resistor device 820 described above with respect to FIGS. 8 and 9.

Resistor device 1451 of FIG. 14 and resistor device 1557 of FIG. 15 are used to adjust the resistance of rotating the resistor device 1420 and the resistor device 1520, respectively. Resistor device 1451 includes at least one arm that extends from a housing 1456. In this case, there are two arms (arm 1453 and arm 1455) that extend from a housing 1456 to the resistor device 1420. In this case, arm 1453 contacts the top surface 1423 of the resistor device 1420, and arm 1455 contacts the bottom surface 822 of the resistor device 1420.

The resistor device 1420 in this case works mechanically. For example, there can be one or more components (e.g., motor, power source, controller) disposed within the housing 1456 of the resistor device 1420. Such components can be used to mechanically control the position of arm 1453 and arm 1455 relative to the top surface 1423 and the bottom surface 1422 of the resistor device 1420. The harder that arm 1453 is pressed against the top surface 1423 and/or the harder that arm 1455 is pressed against the bottom surface 1422 by the components disposed within the housing 1456, the harder that a user must work to rotate the resistor device 1420.

Controls to operate the mechanical components of the resistor device 1420 can be located in any of a number of locations. For example, controls to operate the mechanical components of the resistor device 1420 can be disposed on the housing 1456. Alternatively controls to operate the mechanical components of the resistor device 1420 can be located remotely, as with a wireless remote control device that can be controlled by a user.

The resistor device 1557 of FIG. 15 can be substantially the same as the resistor device 1451 of FIG. 14, except that arm 1553 and arm 1555 of the resistor device 1557 are controlled pneumatically rather than mechanically. As a result, resistor device 1557 includes a source of pressurized fluid 1559 (e.g., a pneumatic line) that has a line 1558 running between it and the housing 1556. The one or more components within the housing 1556 and/or external to the housing 1556 can be suitable for pneumatic systems. Such components can include, but are not limited to, a valve, a controller, a sensor, and a compressor.

Figure 16:
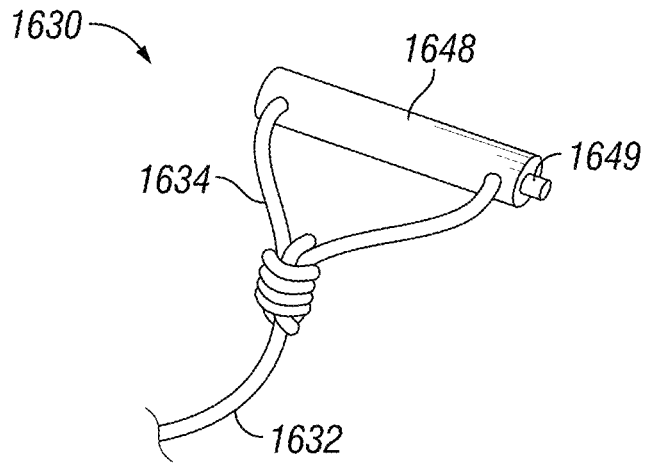
FIG. 16 shows a strap in accordance with certain example embodiments.

FIG. 16 shows a strap 1630 in accordance with certain example embodiments. The strap 1630 of FIG. 16 is substantially the same as the straps discussed above, except as described below. Specifically, the strap 1630 of FIG. 16 includes a control mechanism 1649 that can be used by a user to control an amount of resistance applied to the use of that exercise device (in this case, a strap 1630) and/or another exercise device (e.g., resistive device 1451, resistive device 1557, resistive device 1420, resistive device 1520).

The control mechanism 1649 can have one or more of any of a number of components and/or configurations. For example, the control mechanism 1649 can include a push-button, a dial, a slidbar, a switch, and a graphical user interface. In addition, or in the alternative, the control mechanism 1649 can be a separate device, such as a remote control, that works with wired and/or wireless technology.

Figure 17:
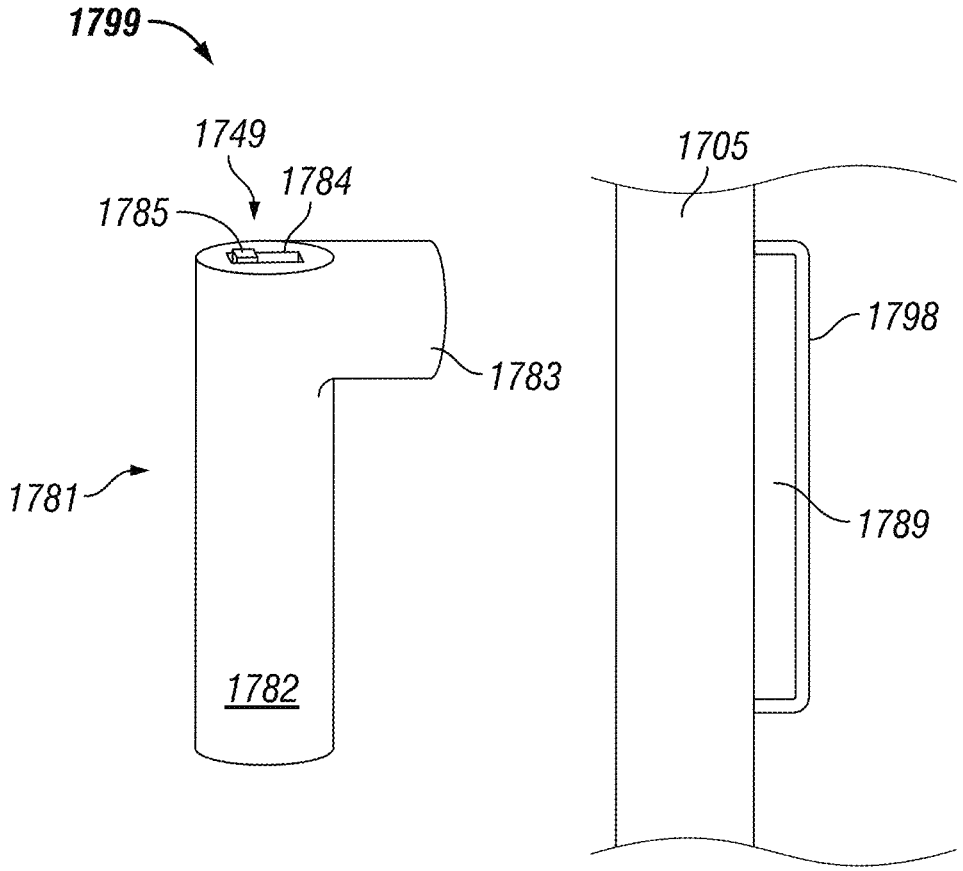
FIG. 17 shows another resistor device in accordance with certain example embodiments.

FIG. 17 shows another resistor device 1799 in accordance with certain example embodiments. In this case, the resistor device 1799 of FIG. 17 does not require a physical coupling between the base component 1705 (or, more specifically, the frame thereof) and what the user uses to perform exercise. Here, the resistor device 1799 uses resistance based on magnetic forces. The resistor device includes a handle 1781 and a base device 1789. The user holds and performs motions with the handle 1781, and the base device 1789 is placed within a pocket 1798 of the base component 1705. The handle 1781 includes a magnet, and similarly the base device 1789 includes another magnet.

The magnet of the handle 1781 can have the same or opposite polarity relative to the magnet of the base device 1789. The polarity of one magnet can be changed at any time. When the polarities of the magnets are the same, the handle 1781 and the base device 1789 naturally repel each other, and so a user must exert a force greater than the magnetic force to move the handle 1781 toward the base device 1789. Conversely, when the polarities of the magnets are opposite each other, the handle 1781 and the base device 1789 naturally attract each other, and so a user must exert a force greater than the magnetic force to move the handle 1781 away from the base device 1789. In either case, the closer the handle 1781 and the base device 1789 are to each other, the greater the force exerted by the user must be.

The handle 1781 can include one or more of a number of features. For example, as shown in FIG. 17, the handle 1781 can include body 1782, an extension 1783, and a control mechanism 1749. The body 1782 is the portion of the handle 1781 where a user holds onto the handle 1781. The body 1782 can also form a cavity inside of which is disposed one or more of a number of components, including but not limited to a magnet, a battery, and electronic components. The control mechanism 1749 is substantially the same as the control mechanism 1649 described above, but in this case the control mechanism 1749 includes a slidebar 1784 with a selector 1785.

The extension 1783 can allow for a physical link between the handle 1781 and an exercise device disposed on the base component 1705 of the wearable gym. For example, the extension 1783 can include one or more coupling features (not shown) (e.g., mating threads, a hook, a snap feature, Velcro) that couples to an exercise device (e.g., a strap). In this way, the resistor device 1799 can work using only magnetic resistance, only mechanical resistance, or a combination of both.

Figure 18:
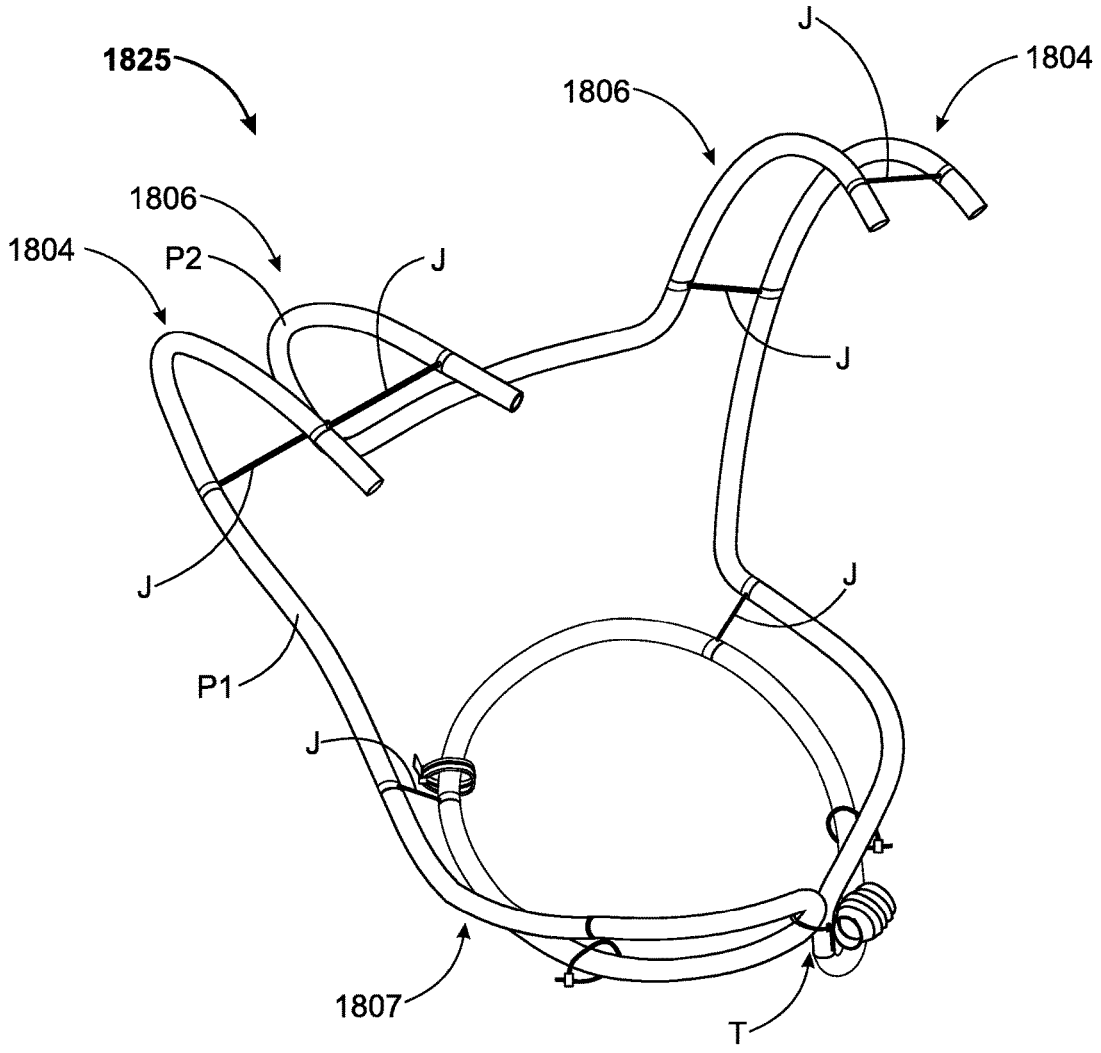
FIG. 18 shows a frame of a wearable gym in accordance with certain example embodiments.

FIG. 18 shows a frame 1825 (a type of base component) of a wearable gym in accordance with certain example embodiments. Referring to FIGS. 1-18, the frame 1825 of FIG. 18 is a rigid or semi-rigid structure that can have any of a number of configurations. In this case, the frame 1825 is made of plastic (e.g., PVC) tubing and has a top portion 1806 and a bottom portion 1807. Using PVC or some other type of plastic for the frame 1825 makes the frame lightweight while also providing sufficient stiffness to maintain stability on a user's torso when the user performs exercises using the wearable gym.

The top portion 1806 of the frame 1825 extends from the back (the portion of the frame that is adjacent to the back of a user when the user wears the frame 1825) and over each shoulder at point 1804. In this particular example, the top portion 1806 is made of two pieces. One piece P1 is a continuous piece of PVC pipe that starts at one shoulder feature 1804, continues to form the bottom portion 1807, and finishes at the other shoulder feature 1804. The other piece P2 is a relatively shorter single piece of PVC pipe that starts at one shoulder 1804, traverses down part of the back, and then ascends to the other shoulder 1804.

Piece P1 and piece P2 of the frame 1825 shown in FIG. 18 are joined to each other at a number of points using joining pieces J. A joining piece J can be, for example, string, zip ties, wire, a bracket, a brace, a clip, epoxy, a weld, or a rubber band. Alternatively, a frame 1825 can be a single continuous piece (P1 only) or three or more pieces (e.g., P1, P2, P3, P8) that are joined together using multiple joining pieces P. While the pieces of the frame 1825 shown in this example are tubes, a piece of the frame 1825 can have any of a number of other shapes and/or configurations. For example, a piece of the frame 1825 can be an elongated flat plate on the back of the frame 1825, which could be used for certain exercise devices, such as detachable component 1271 or base device 1789 described above.

As discussed above, the configuration of the frame 1825 and its various pieces can vary. For example, in this case, the top portion 1806 and the bottom portion 1807 are joined where the frame is configured to abut against a user's back, but portion P1 and portion P2 are not joined to each other along a user's chest. Specifically, portion P1 and portion P2 terminate shortly after passing over the shoulder features 1804, which are configured to rest atop the shoulders of a user. Further, the bottom portion 1807 of the frame 1825 is configured to contact the abdomen of the front side a user. In this way, the frame 1825 of FIG. 18 does not make direct contact with the chest of a user.

The bottom portion 1807 of the frame 1825 is configured to be disposed around the waist area of a user and is joined together in the front (corresponding to the abdomen of a user) by a securing tie T. The securing tie T can be any type of device, collection of devices, or mechanism that secure the two parts of the front portion 1807 of the frame 1825, and yet can also allow the two parts of the front portion 1807 of the frame 1825 to be decoupled from each other so that a user can more easily remove the frame 1825.

Figure 19A:
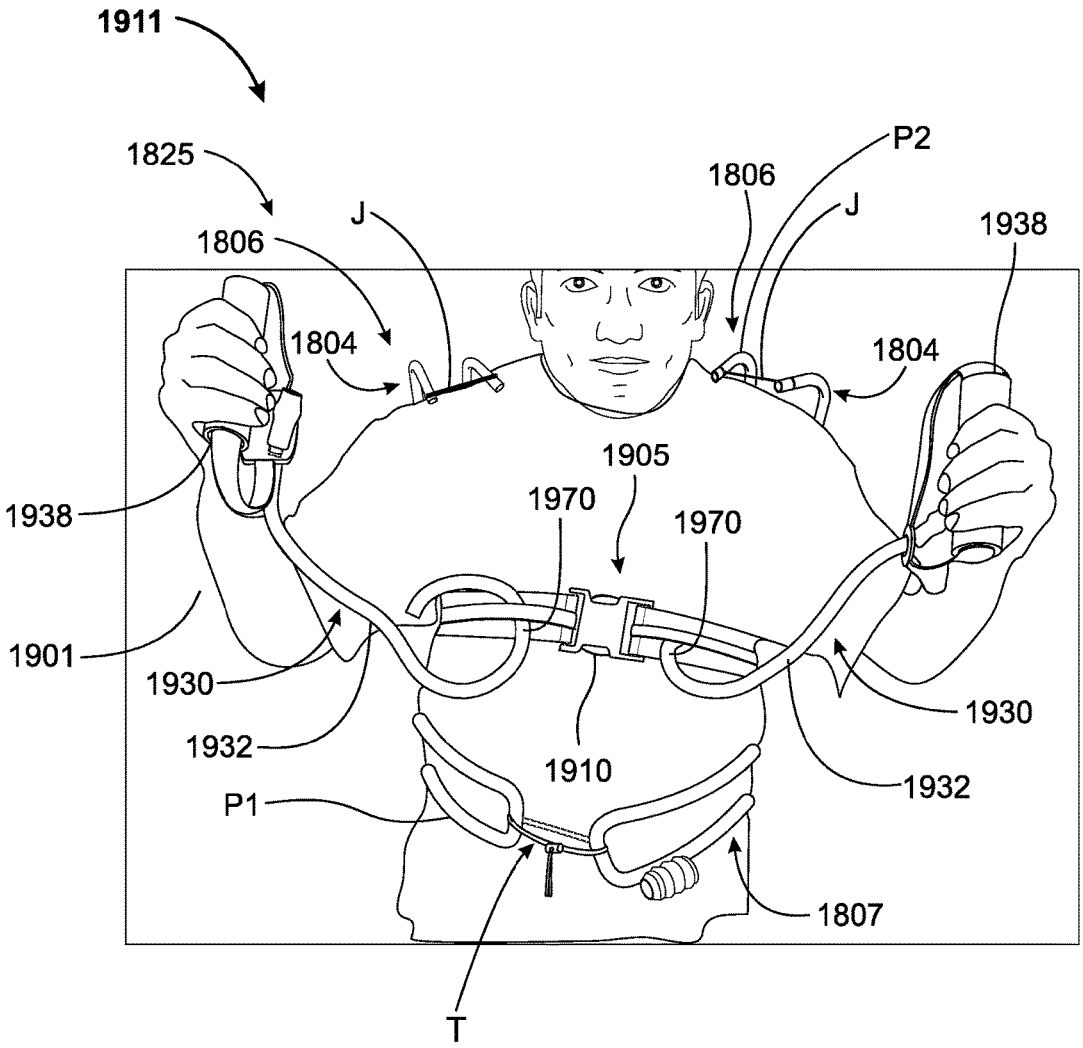
FIGS. 19A-19C shows a subassembly that includes the frame of FIG. 18 with enhancements in accordance with certain example embodiments.
Figure 19B:
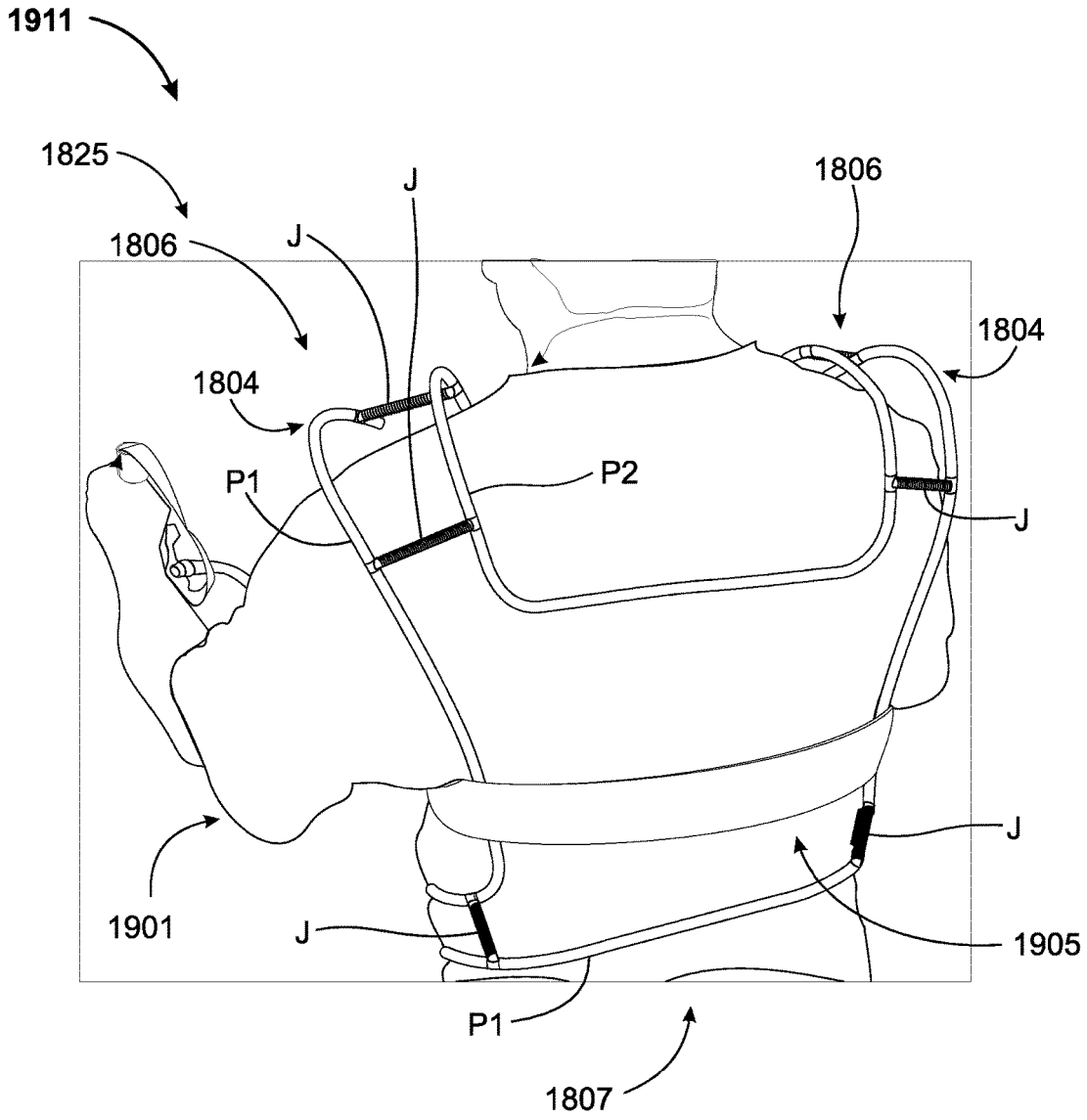
Figure 19C:
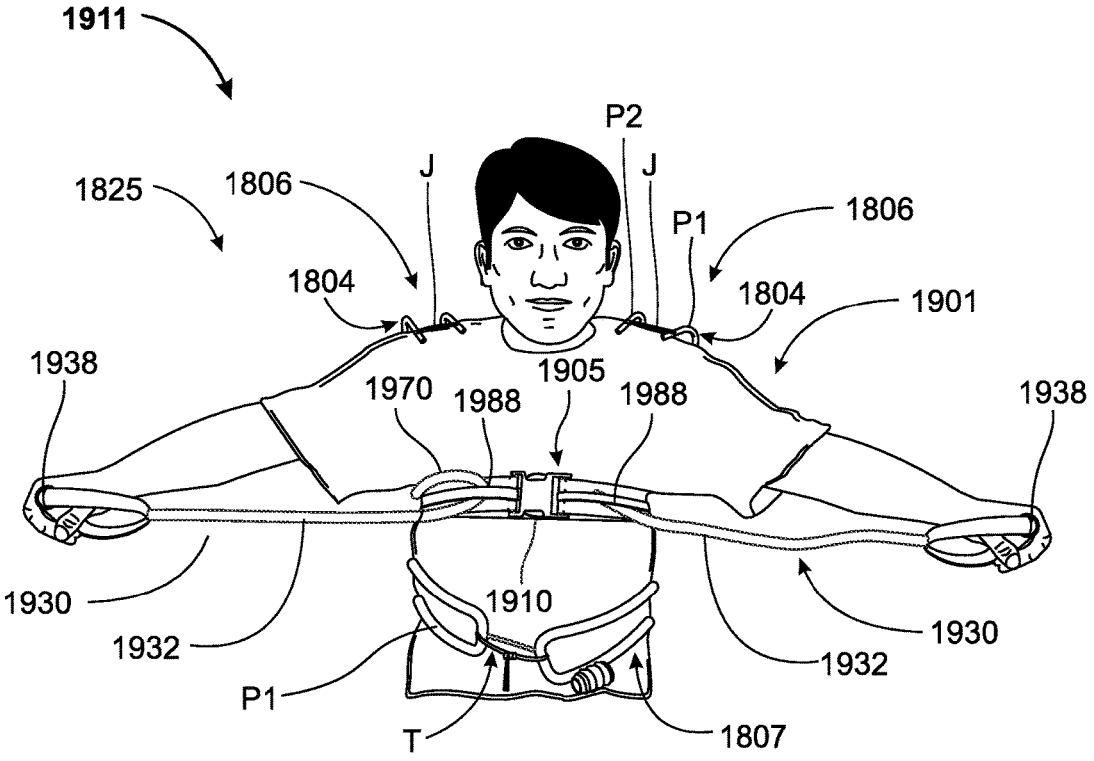

FIGS. 19A-19C shows a subassembly 1911 that includes the frame 1825 of FIG. 18 with enhancements in accordance with certain example embodiments. Specifically, FIG. 19A shows a front view of the subassembly 1911. FIG. 19B shows a rear view of the subassembly 1911. FIG. 19C shows another front view of the subassembly 1911. Referring to FIGS. 1-19C, the subassembly 1911 includes the frame 1825 of FIG. 18, a base component 1905, and two exercise devices in the form of flexible straps 1930.

The base component 1905 in this case is a band that wraps around the portion of the frame 1825 where the top portion 1806 joins with the bottom portion 1807. In this case, the base component 1905, when worn by a user 1901, wraps around the middle of the torso and back, just under the armpits. The base component 1905 of FIGS. 19A-19C includes a fastening feature 1910 (e.g., a detachable buckle) that secures the base component 1905 around the frame 1825 and the user 1901. In some cases, the length of the base component 1905 is adjustable to fit users 1901 having a variety of chest sizes.

The base component 1905 also includes one or more coupling features 1988 for coupling to an exercise device. In this case, each coupling feature 1988 of a base component 1905 is a reinforced aperture that traverses the base component 1905 and receives the body 1932 of the strap 1930 (which in this example is the exercise device). The aperture can be reinforced with a plastic or metal grommet to maintain the integrity of the coupling feature 1988 with use of the exercise device over time.

The two straps 1930, one for each arm of the user 1901, is similar to the straps described above. For example, each strap 1930 of FIGS. 19A-19C includes a body 1932, a coupling feature 1970 disposed at a proximal end of the body 1932, and a handle 1938 disposed at a distal end of the body 1932. Each coupling feature 1970 couples to the base component 1905 and remain secure when the straps 1930 are in use. In this case, a coupling feature can be a knot or other anchor created in the proximal end of the body 1932 on the inner facing side (i.e., the side facing the user 1901) to prevent the proximal end of the body 1932 from being pulled through the corresponding coupling feature 1988 of the base component 1905. Since the body 1932 of each strap 1930 is flexible (elastic in this case), the body 1932 offers resistance to the user 1901 as the user 1901 forces the handles 1938 away from the body and draws the handles 1938 back toward the body in a controlled manner.

As each strap 1930 is used (e.g., the handles 1938 are pushed away from the body of the user 1901, the handles 1938 are released toward the body of the user 1901 in a controlled fashion), the frame 1825, secured to the body of the user 1901 by the base component 1905, remains stable and relatively fixed against the body of the user 1901, allowing the user 1901 to exercise without risk of injury caused by the example wearable gym. In some cases, the frame 1825, the base component 1905, and/or another feature of the wearable gym (or portions thereof) can be disposed within a cover.

Figure 20:
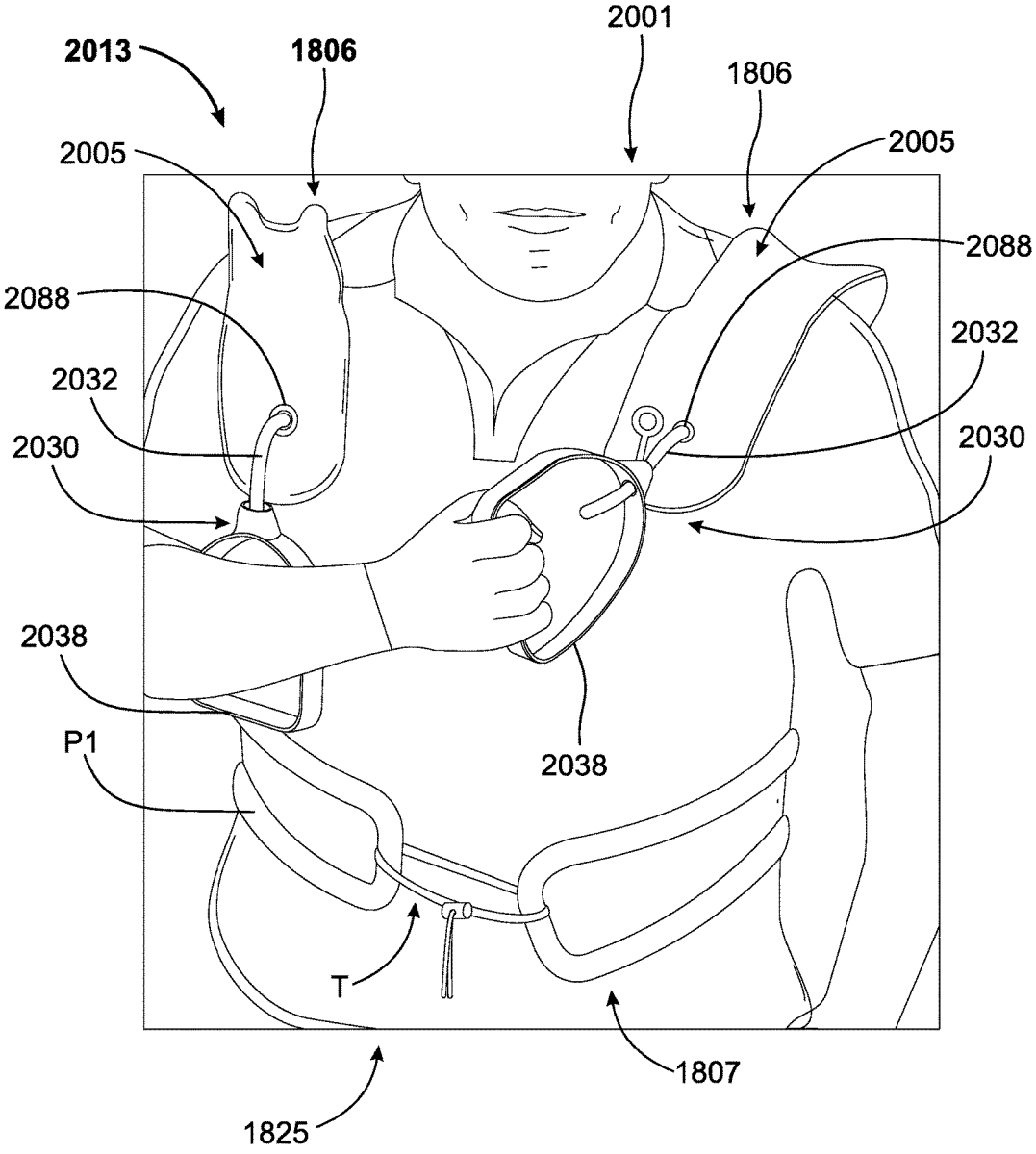
FIG. 20 shows another subassembly that includes the frame of FIG. 18 with alternative enhancements in accordance with certain example embodiments.

FIG. 20 shows a subassembly 2013 that includes the frame 1825 of FIG. 18 with alternative enhancements in accordance with certain example embodiments. Referring to FIGS. 1-20, the subassembly 2013 of FIG. 20 differs from the subassembly 1911 of FIGS. 19A-19C in that the subassembly 2013 of FIG. 20 has two base components 2005 that are disposed around the distal end of the top portion 1806 of the frame 1825. In this example, each base component 2005 can slide over the distal end of the top portion 1806 of the frame 1825 and be secured in place (e.g., using a joining piece).

Each base component 2005 also includes one or more coupling features 2088 for coupling to an exercise device. In this case, each coupling feature 2088 of a base component 2005 is a reinforced aperture that traverses the base component 2005 and receives the body 2032 of the strap 2030 (which in this example is the exercise device). The aperture can be reinforced with a plastic or metal grommet to maintain the integrity of the coupling feature 2088 with use of the exercise device over time.

As stated above, the exercise devices in this example are also flexible straps 2030, and each strap 2030 is coupled to a base component 2005. Specifically, the two straps 2030, one for each arm of the user 2001, is similar to the straps described above. For example, each strap 2030 of FIG. 20 includes a body 2032, a coupling feature (hidden from view) disposed at a proximal end of the body 2032, and a handle 2038 disposed at a distal end of the body 2032. Each coupling feature 2070 couples to a base component 2005 and remain secure when the straps 2030 are in use. In this case, a coupling feature can be a knot or other anchor created in the proximal end of the body 2032 on the inner facing side (i.e., the side facing the user 2001) to prevent the proximal end of the body 2032 from being pulled through the corresponding coupling feature 2088 of the base component 2005.

As each strap 2030 is used (e.g., the handles 2038 are pushed away from the body of the user 2001, the handles 2038 are released toward the body of the user 2001 in a controlled fashion), the frame 2025, secured to the body of the user 2001 by the base component 2005, remains stable and relatively fixed against the body of the user 2001, allowing the user 2001 to exercise without risk of injury caused by the example wearable gym. Since the base components 2030 are disposed in the area of the shoulder of the user, rather than around the torso as in FIGS. 19A-19C, the exercises performed by the user 2001 in FIG. 20 work different muscles than those worked by the user 1901 in FIGS. 19A-19C.

Example embodiments provide a base component and frame combination that utilizes one or more exercise devices. When a user wears the base component and frame, and engages an exercise device, the user can be exercising. Example embodiments can offer various exercises (e.g., shadow boxing, simulated pushups) that can provide any of a number of types of exercise, including but not limited to cardiovascular exercise, aerobic exercise, and strength training, toning. Example embodiments can also track the amount of exercise performed by a user. The exercise devices of example embodiments can be adjusted (e.g., moved at various locations on the frame, change the resistance) by a user to provide flexibility in the part of the body being exercised, the type of exercise being performed, and the exercise device being used.

Example embodiments provide a number of benefits. Examples of such benefits include, but are not limited to, ease of use, ease of changing exercising devices or characteristics (e.g., resistance) thereof, low maintenance, use in various locations, portability, increased strength, flexibility, and/or overall health of a user, and ease of replacing exercise devices that may fail. Example embodiments can be used as a sole source of exercise for a user. Example embodiments can also be used to augment existing exercise routines of a user.

Although embodiments described herein are made with reference to example embodiments, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A wearable gym, comprising:

a frame comprising a first portion and a second portion coupled to the first portion, wherein the first portion is configured to be disposed over shoulders of a user, wherein the second portion is configured to be disposed around a waist of the user, wherein the frame is substantially rigid and comprises tubing made of PVC, wherein the tubing is shaped to conform to the torso of the user;

a base component disposed around at least a portion of the frame; and at least one exercise device coupled to at least one coupling feature of the base component, wherein the at least one exercise device is configured to burn calories of the user when the user engages the at least one exercise device, wherein the first portion and the second portion of the frame are coupled to each other at a first location corresponding to a back side of a torso of the user without being coupled to each other at a second location corresponding to a front side the torso of the user.

2. The wearable gym of claim 1, wherein the at least one exercise device comprises at least one resistor device, wherein the at least one resistor device comprises a range of resistances, wherein the user adjusts the at least one resistor device to select a resistance within the range of resistances.

3. The wearable gym of claim 2, wherein the at least one resistor device comprises a coupling feature that couples to a complementary coupling feature disposed on a strap, wherein the strap is pulled by the user, wherein the strap is part of the at least one exercise device.

4. The wearable gym of claim 3, wherein the at least one resistor device comprises a first resistor device and a second resistor device, wherein the first resistor device comprises a pulley, and wherein the second resistor device controls a resistance applied to the pulley when the pulley rotates.

5. The wearable gym of claim 3, wherein the at least one resistor device comprises a compression spring.

6. The wearable gym of claim 1, further comprising:

an anchor component coupled to the base component, wherein the anchor component stabilizes the base component and the frame relative to the user when the user engages the at least one exercise device.

7. The wearable gym of claim 1, wherein the at least one exercise device comprises at least one resistor device, wherein the at least one resistor device provides magnetic resistance to a movement made by the user, wherein the at least one resistor device comprises a base device having a first magnet and a handle having a second magnet.

8. The wearable gym of claim 1, wherein the base component comprises at least one device coupling feature disposed on an outer surface of the base component, wherein the at least one device coupling feature receives a base component coupling feature of the at least one exercise device.

9. The wearable gym of claim 8, wherein the at least one exercise device comprises a strap, wherein the at least one base component coupling feature is disposed at a first end of the strap.

10. The wearable gym of claim 9, wherein the strap further comprises a handle at a second end of the strap, wherein the handle is configured to receive at least one selected from a group consisting of a hand and a foot of the user, and wherein the handle comprises a control mechanism that controls a resistance of the at least one exercise device.

11. The wearable gym of claim 1, wherein the base component comprises an audio device that outputs binaural beat sounds.

12. The wearable gym of claim 11, wherein the base component further comprises an audio output feature, wherein the audio output feature is coupled to the audio device.

13. The wearable gym of claim 12, further comprising:

an energy storage device coupled to the audio device, wherein the energy storage device provides power to the audio device.

14. The wearable gym of claim 1, wherein the base component comprises a receiving feature disposed on an outer surface of the base component, wherein the receiving feature is configured to receive an audio device.

15. The wearable gym of claim 1, wherein the at least one exercise device comprises a vibrating device, wherein the vibrating device emits a plurality of energy pulses.

16. The wearable gym of claim 15, further comprising:

a power supply disposed within the base component, wherein the power supply provides power to the vibrating device.

17. The wearable gym of claim 15, wherein the vibrating device is part of a detachable component that is located by the user in an area of the base component that corresponds to an abdomen of the user.

18. The wearable gym of claim 1, further comprising:

a controller configured to track movements of the at least one exercise device when the user engages the at least one exercise device.

* * * * *